US006607455B1

(12) United States Patent
Petras

(10) Patent No.: US 6,607,455 B1
(45) Date of Patent: Aug. 19, 2003

(54) PORTABLE/FOLDABLE SOCCER GOAL

(75) Inventor: Kenneth A. Petras, 7921 Byron Ave., Suite 306, Miami Beach, FL (US) 33141

(73) Assignee: Kenneth A. Petras, Miami, FL (US)

( * ) Notice: Subject to any disclaimer, the term of this patent is extended or adjusted under 35 U.S.C. 154(b) by 0 days.

(21) Appl. No.: 10/109,147

(22) Filed: Mar. 28, 2002

(51) Int. Cl.[7] ..... A63B 63/00
(52) U.S. Cl. ..... 473/478; 273/400
(58) Field of Search ..... 473/478, 446, 473/432, 415; 273/400

(56) References Cited

U.S. PATENT DOCUMENTS

| | | | |
|---|---|---|---|
| 4,286,786 | A | 9/1981 | Papadopoulos |
| 4,921,257 | A | 5/1990 | Heller |
| 5,048,844 | A | 9/1991 | Haseltine |
| 5,181,725 | A | 1/1993 | Leras et al. |
| 5,330,199 | A | 7/1994 | Vand |
| 5,496,040 | A | 3/1996 | Amburgey et al. |
| 5,961,403 | A | 10/1999 | Caruso |
| 6,287,220 | B1 | 9/2001 | Caruso |

*Primary Examiner*—Paul T. Sewell
*Assistant Examiner*—M. Chambers

(57) ABSTRACT

A structure consisting of five main versatile tubular components, each serving a structural purpose for soccer skill training. Two of the components contiguous, have an identical trapezoid shape, with specific six-inch radius curved angles (ninety, ninety-five, one hundred thirteen and sixty two degree inside curved angles). They are considered the base of this structure called Side Frame (10), which include Side Frame Wide-hole Nylon Netting (60). Two additional contiguous components are different sized rectangular rebounding planes, Large Frame (40) containing a tightly wound Large Frame Vinyl Coated Mesh (64) rebound netting and Small Frame (30) containing a tightly wound Small Frame Vinyl Coated Mesh (62) rebound netting. The last contiguous component is a Stabilizing Bar (50), which stabilizes this apparatus and converts into a Back Passer. The entire structure transforms into a range of modes, facilitating different size soccer goals and numerous soccer skill training rebounding planes at both inclines and declines, along with portability.

1 Claim, 24 Drawing Sheets

PORTABLE/FOLDABLE SOCCER GOAL

CROSS-REFERENCE TO RELATED APPLICATIONS

Figure 1A:
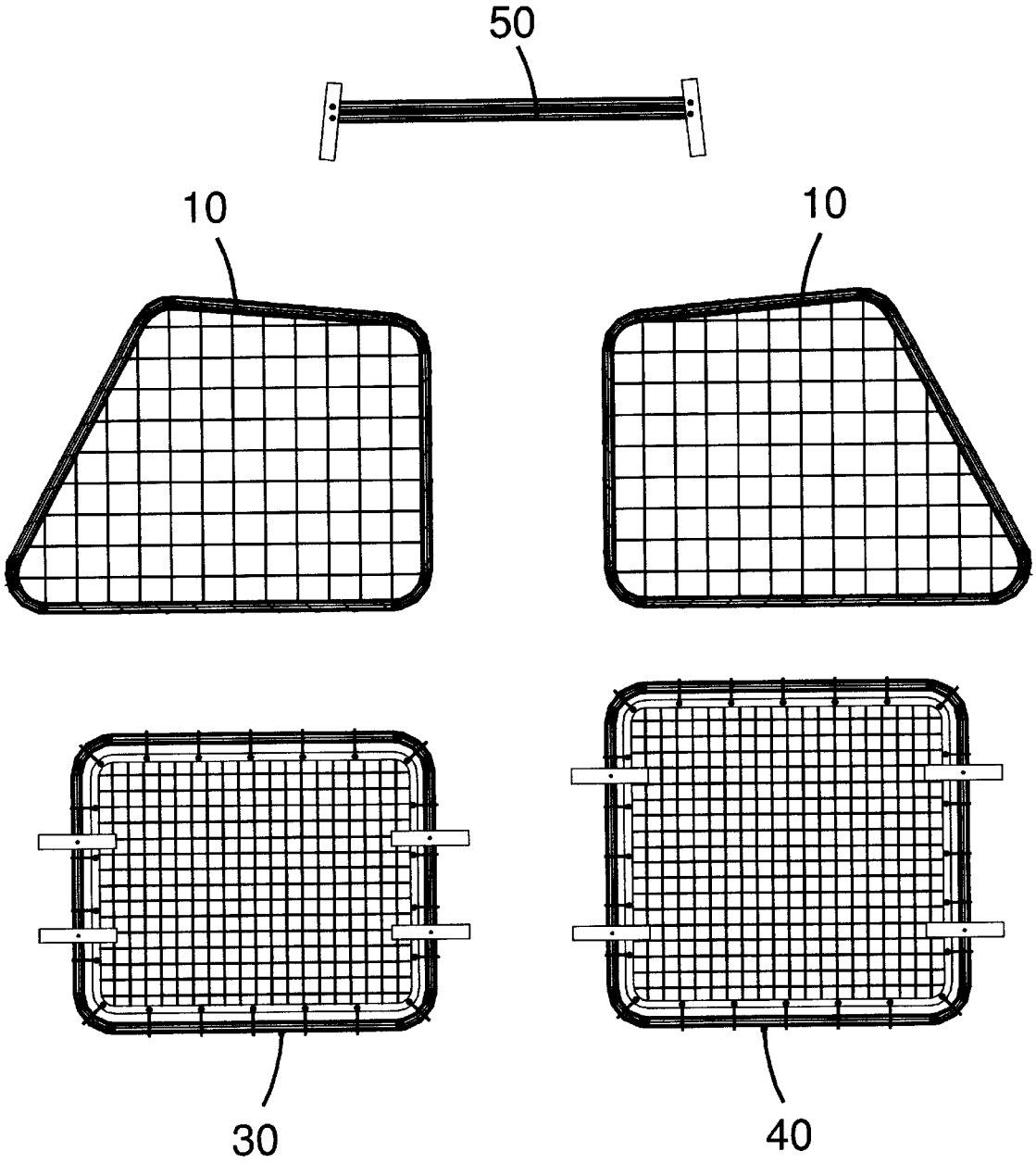

Not applicable.

BACKGROUND

1. Field of Invention

This invention relates to soccer goals, specifically to portable transforming soccer training goals with multiple angled rebounding surfaces for returning a soccer ball or balls to a kicker, soccer goalie or additional training soccer players. The soccer-training goal of this invention is also a target to kick a soccer ball into, around or over and interchanges into different size soccer goals for game practice and play. The soccer goal of this invention has a system of training to assist in properly preparing one or multiple players the necessary soccer skills and techniques for the sport of soccer.

BACKGROUND

2. Description of Prior Art

Originally soccer goals were made for ease of portability and had no training features. This problem has been partially solved by the implementation of unconventional additions to a standard soccer goal, but these had and still have significant problems.

Thereafter, inventors created several types of soccer training goals, which have to be mounted into the ground surface for stability. U.S. Pat. No. 5,048,844 to Haseltine (1991), U.S. Pat. No. 6,287,220 B1 to Caruso (2001) and U.S. Pat. No. 5,330,199 to Vand (1994), all disclose the need for mounting the device into the ground surface. Thus, each device cannot be used for training on an indoor surface, which is typically a hard flat impenetrable surface. The need to mount to a ground surface limits the use of the devices to an outdoor soft playing field.

Subsequently, inventors created several types of rebounding soccer goals, which are limited to how the soccer ball rebounds. U.S. Pat. No. 6,287,220 B1 to Caruso (2001), U.S. Pat. No. 5,048,844 to Haseltine (1991) and U.S. Pat. No. 4,286,786 to Papadopoulos (1981) all disclose the ability to rebound the soccer ball, but are restricted to how the ball is returned to the player. ULTIMAGOAL rebounds the soccer ball from different angled rebounding planes (inclined and declined angles), either at high levels in the air for heading and trapping the soccer ball, at low levels in the air or bouncing along the ground surface for volleying and trapping the soccer ball, as well as consistently along the ground surface for passing training. None of the past Patents described have multiple angled rebound planes with inclined and declined planes for rebounding the soccer ball at all levels.

Several inventors created numerous types of soccer goals with the feature of being portable, but with no rebounding surfaces for training capabilities. U.S. Pat. No. 5,496,040 to Amburgey et al discloses a portable soccer and hockey goal, but has no training features.

A number of inventors created numerous types of soccer training targets to kick a soccer ball into, at or through as a target. U.S. Pat. No. 5,181,725 to Leras et al (1993), U.S. Pat. No. 5,961,403 to Caruso (1999), U.S. Pat. No. 4,921,257 Heller (1990) and U.S. Pat. No. 5,330,199 to Vand (1994) all disclose the function of being a target, but again are limited in their use, lacking in developing all of the proper soccer skills a soccer player needs from head to toe. One example of a soccer skill necessary to be developed is trapping a soccer ball correctly using various parts of the soccer players body and none of the above-mentioned U.S. Patents fulfill this important soccer training skill, which is just one of the numerous training techniques ULTIMAGOAL has to offer. A player or players can kick a soccer ball into ULTIMAGOAL or rebound a soccer ball at various angles off said training device, train passing techniques with precision rolling on the ground surface, practice chipping a soccer ball over said training device, train by kicking a soccer ball around said training device, transform ULTIMAGOAL into different size soccer goals and disconnect said training device in seconds for ease of portability, but nevertheless all the soccer devices or apparatus's heretofore known suffer from a number of disadvantages.

There are very few soccer equipment stores, where an average soccer consumer may purchase a soccer goal or soccer training apparatus. The most cost effective place to purchase a soccer goal or training apparatus are through the Internet or Soccer Magazines. These past inventions all suffer from a number of disadvantages.

(a) They are limited in their functionality.

(b) They are extremely expensive for an average consumer.

(c) They serve one or few purposes and have limited training techniques.

(d) They are unconventional for portability.

(e) They do not provide full skill training knowledge or effective instruction.

(f) They fail to train all of the necessary soccer skills a soccer player needs to be able to properly control a soccer ball during play.

Numerous training goals or rebounding apparatus's are presented in the prior art. Even though these training goals or rebounding apparatus's are appropriate for specific functions, they fall short in training soccer players all of the essential soccer skills and are different from the present invention.

SUMMARY

Objects, Purpose and Advantages

In accordance with the present invention a structure made of four individual tubular frames and one tubular straight stabilizing bar all being contiguous and all are made of lightweight, durable tubing for portability, each tubular frame component having a unique shape and dimension creating a means for different training modes, whereby transforming from two different size soccer goals to a soccer training multi-planed (inclined and declined angles) rebounding device. Accordingly, several objects, purposes and advantages of the present invention are described below.

An object of the present invention is to provide a soccer training goal or device, which is free standing and does not have to be mounted into the ground surface, but it does have the capability to be mounted into the ground surface, if necessary.

It is an object of the present invention to provide a soccer training goal or device, which is of lightweight and durable materials for effortless portability.

Another object of the present invention is to provide a soccer training goal or device, which has the ability to assemble and disassemble quickly with simplicity of use and no tools necessary.

An additional object of the present invention is to provide a soccer training goal or device, which is an accurate representation of an actual soccer goal, including an open goal mouth, enclosed sides and enclosed back plane of a soccer goal for stopping or containing the soccer ball once it enters or penetrates the goal mouth.

Another object of the present invention is to provide a soccer training goal or device, which has the ability to convert into two different size soccer goals for soccer training and game play (Small Soccer Goal and Large Soccer Goal).

Yet another object of the present invention is to provide a soccer training goal or device, which transforms into various multiple angled rebounding planes, rebounding the soccer ball to the player in the air at both high and low level angles (incline and decline rebounding angles), as well as rebounding the soccer ball smoothly along the ground surface, utilizing training to all of a soccer players body from head to toe.

It is a further object of the present invention to provide a soccer training goal or device with multiple players rebounding a soccer ball on each side thereof, utilizing different angled rebounding planes at the same time, depending on mode of transformation.

It is yet a further object of the present invention to provide a soccer training goal or device, which includes a system of soccer player skill training techniques.

The Purpose of ULTIMAGOAL is to be safe, educational and a versatile soccer training apparatus for soccer skill training a soccer team (multiple player training) or single player for the game of soccer. ULTIMAGOAL contributes effective soccer skill training to a soccer camp, coach, team or soccer player. ULTIMAGOAL is made to be of lightweight material and detachable, so it has several functions for facilitating proper player training, as well as portability. ULTIMAGOAL main purpose is to train soccer players and fine-tune a soccer team or individual soccer player soccer ball skills for a player or team to have improved control over the soccer ball, distribute a soccer ball with enhanced precision and shoot a soccer ball during play with more superior accuracy to score.

ULTIMAGOAL has numerous Advantages over all soccer-training devices and equipment. ULTIMAGOAL is the ultimate multi-player portable soccer skill training apparatus, utilizing training to all of a players body parts. ULTIMAGOAL has an effective and efficient system of training to follow and can also be converted into several positions for this system of training. Additional advantages are ULTIMAGOAL versatility and interchangeability. The device can train a team or player's soccer ball skills in almost any game situation, assisting soccer coaches in a more efficient manner to fully utilize practice time for all players, including goalies. ULTIMAGOAL is like having a Personal Soccer Trainer, with an easy to follow Soccer Skill Training System to efficiently train soccer player/player's soccer ball control, distribution and accuracy. Still further objects, purposes and advantages will become apparent from a consideration of the ensuing description, operation and drawings.

DRAWING FIGURES

Please View Drawings

FIGS. 1–7A

In the drawings, closely related figures have the same number but different alphabetic suffixes.

FIG. 1A—shows the five main components, which form ULTIMAGOAL.

FIGS. 1B to 1E—show a detailed description of all parts, built-in each of the five main components.

FIG. 2A—2D show essential angles of one of the two identical Side Frame components of ULITIMAGOAL.

Figure 3A:
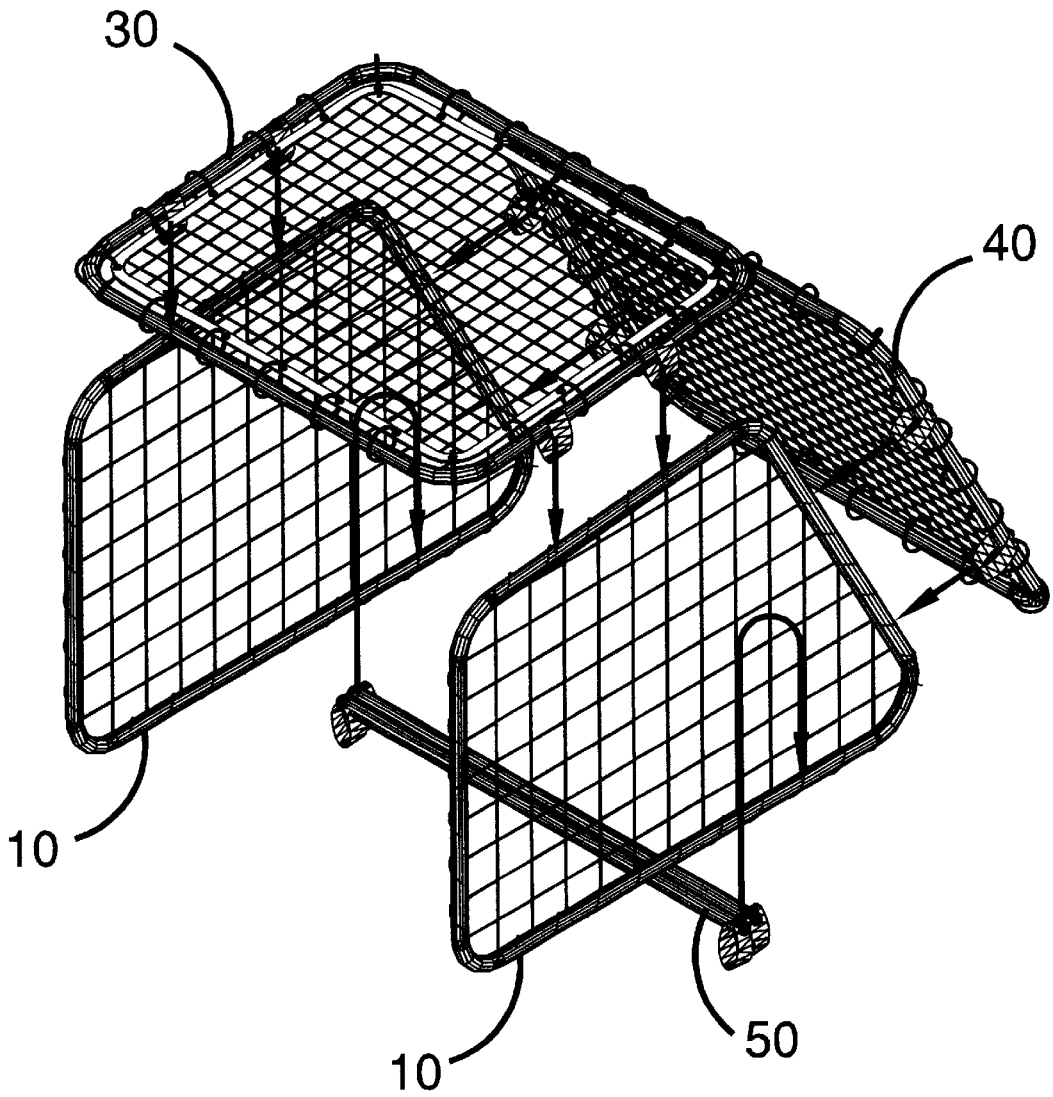
Figure 3B:
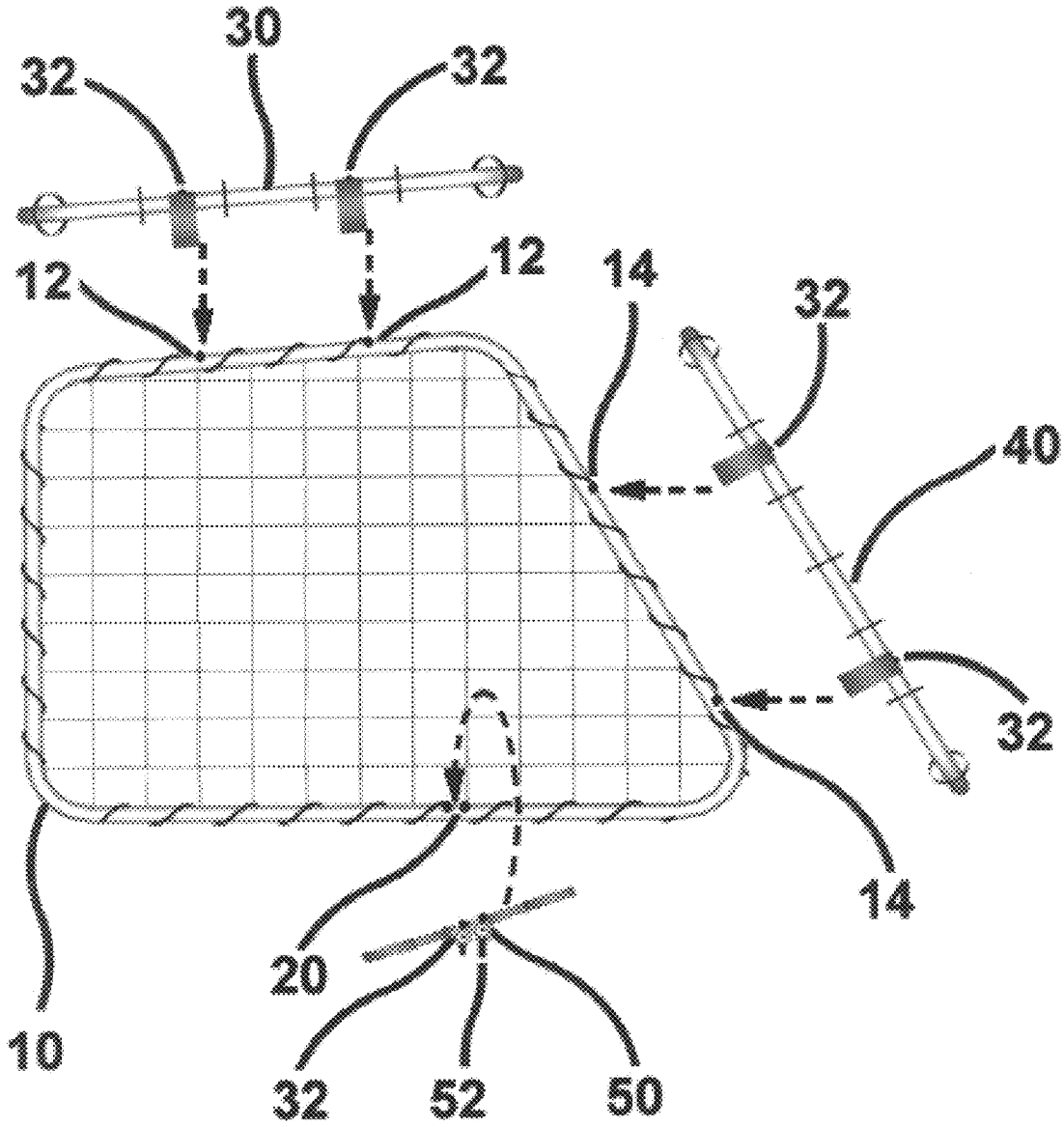
Figure 3C:
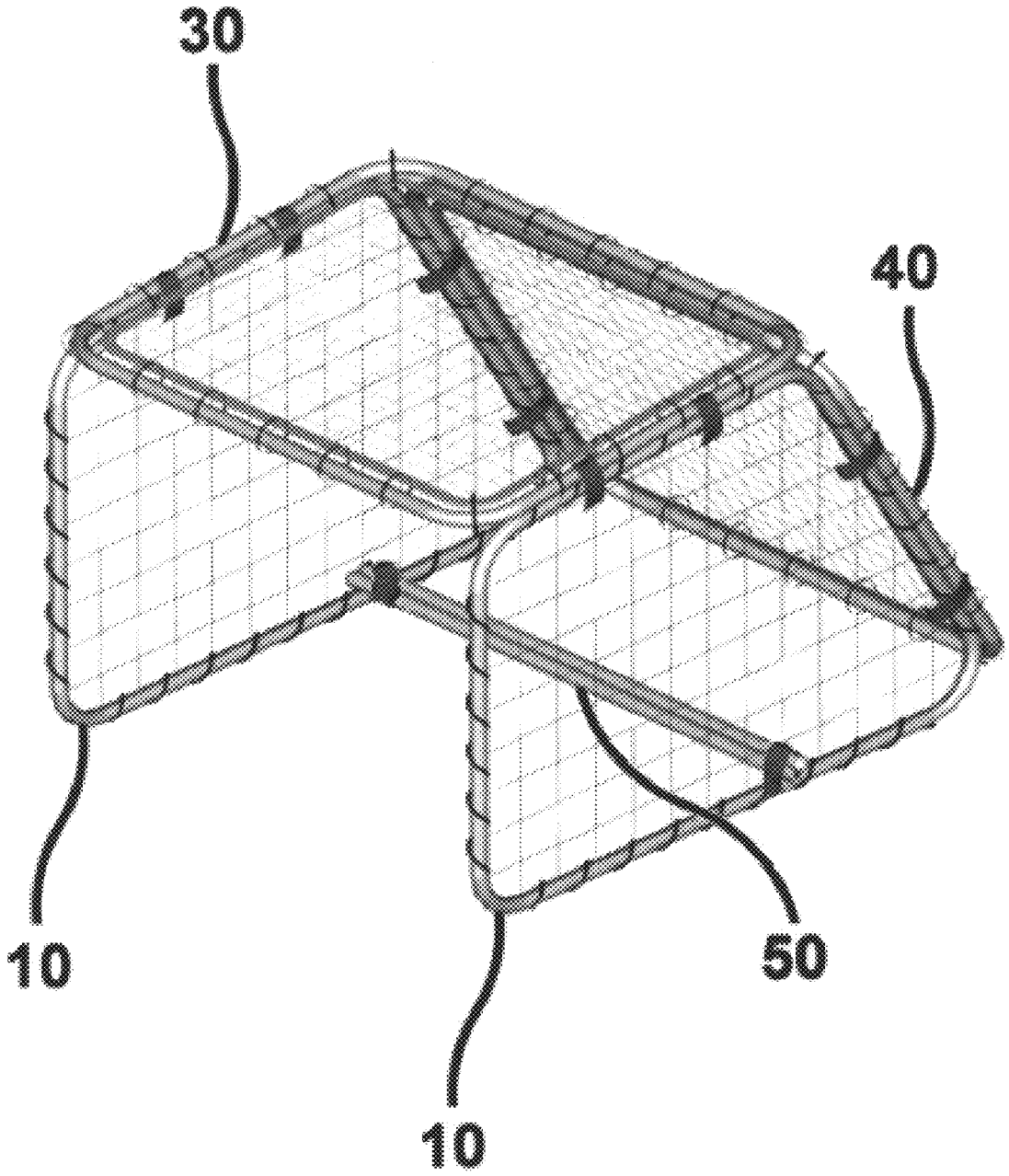

FIGS. 3A to 3C—show the five main components and assembly into ULTIMAGOAL MODE ONE.

FIGS. 4A to 4D—show the five main components and assembly into ULTIMAGOAL MODE TWO.

FIGS. 5A to 5D—show the five main components and assembly into ULTIMAGOAL MODE THREE.

Figure 6A:
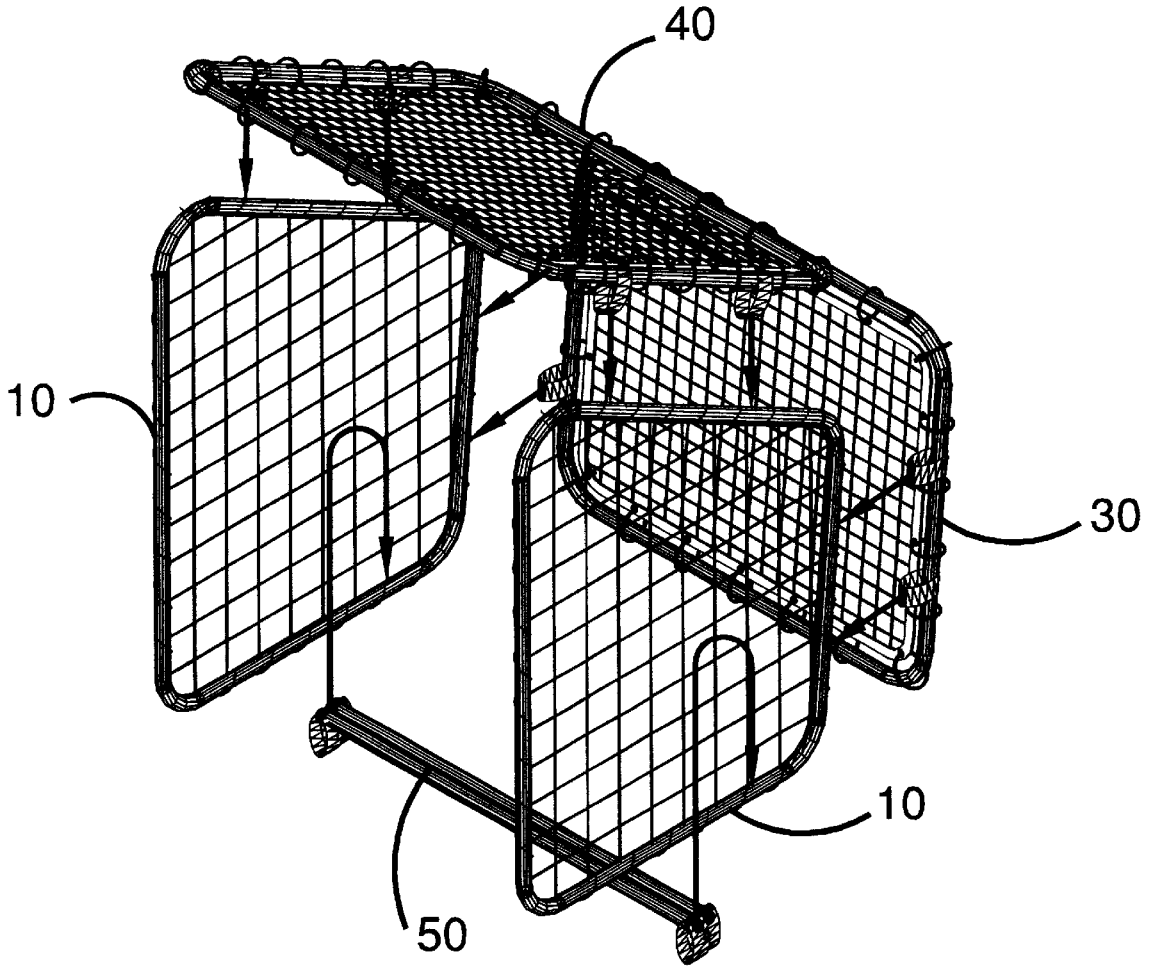
Figure 6B:
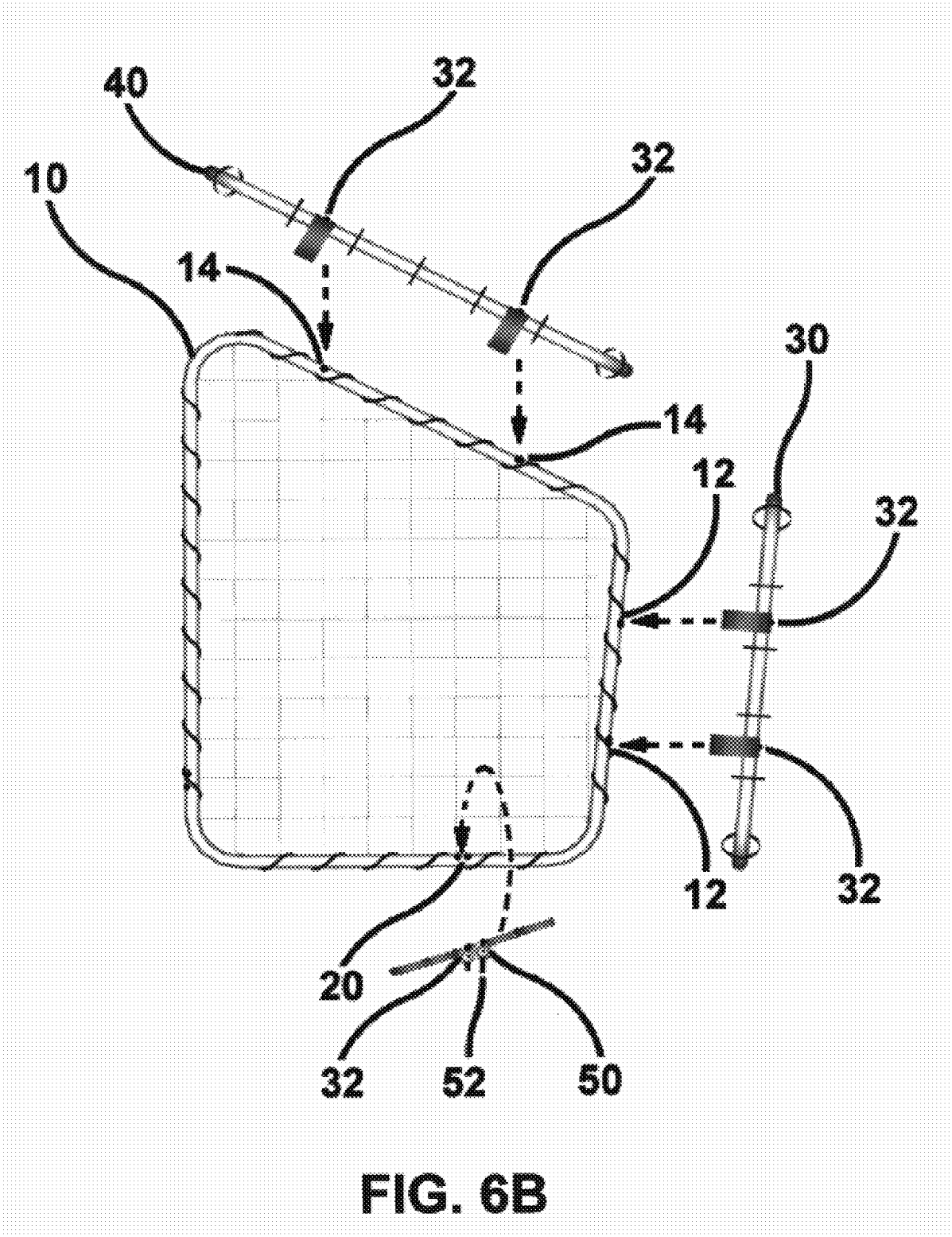
Figure 6C:
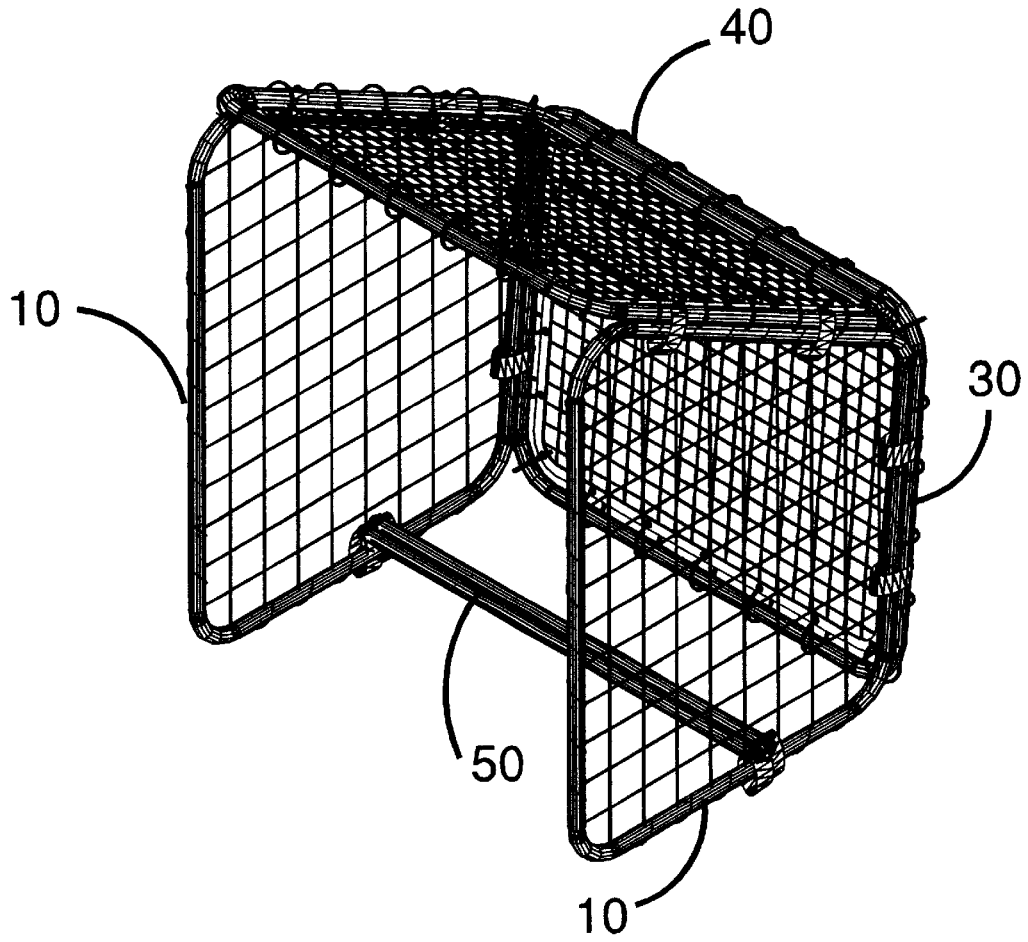

FIGS. 6A to 6C—show the five main components and assembly into ULTIMAGOAL MODE FOUR.

Figure 7A:
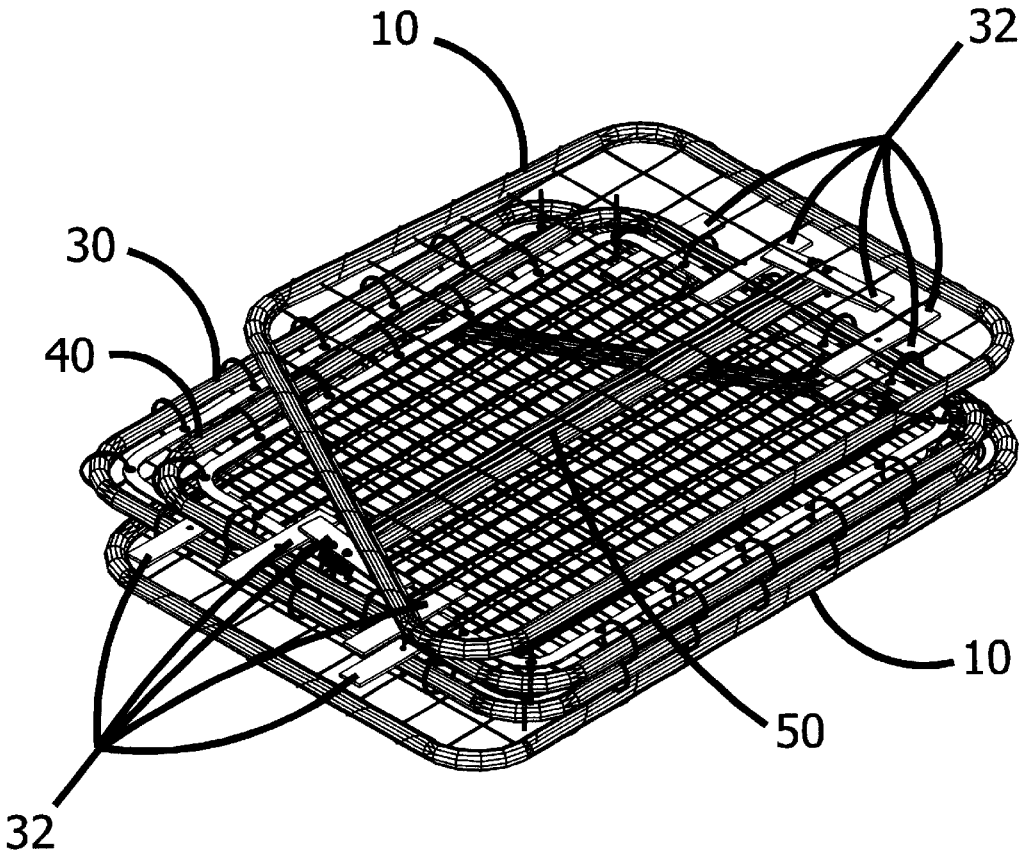

FIG. 7A—shows the five main components and assembly into ULTIMAGOAL PORTABLE MODE, with a detailed observation of each attachment necessary to complete the fifth mode.

REFERENCE NUMERAL IN DRAWINGS

1 Side Frame Ninety Degree Inside Angle
2 Side Frame Ninety-Five Degree Inside Angle
3 Side Frame One Hundred Thirteen Degree Inside Angle
4 Side Frame Sixty-Two Degree Inside Angle
10 Side Frame
12 Small Frame Insert Hole
14 Large Frame Insert Hole
20 Stabilizing Bar Insert Hole
30 Small Frame
32 Bolt & Strap
40 Large Frame
50 Stabilizing Bar
52 Long Bolt
60 Side Frame Wide-hole Nylon Netting
62 Small Frame Vinyl-coated Mesh
64 Large Frame Vinyl-coated Mesh
70 Bungee Cord
80 Ground Spike Hole

DESCRIPTION—FIGS. 1A, 1B, 1C, 1D, 1E—PREFERRED EMBODIMENT

A preferred embodiment of the present invention are illustrated in FIG. 1A, FIG. 1B, FIG. 1C, FIG. 1D, FIG. 1E (all side views)—showing two different rectangular shaped Frames (Small Frame 30, Large Frame 40), two identical Frames (Side Frame 10, Side Frame 10) with various duplicate curved angles and a small straight Stabilizing Bar 50, which are the five main components with the purpose of forming ULTIMAGOAL in its entirety. Each of the five main components numbered in FIGS. 1A–2 Side Frames (10, 10), Small Frame (30), Large Frame (40) and Stabilizing Bar (50) are made of lightweight thin steel tubing (0.035 gauge) with a 1⅜" inch diameter and the four main component Frames all include various six-inch radius curved angles. A more detailed description of each of the five main components, which make up ULTIMAGOAL are represented independently in FIG. 1B, FIG. 1C, FIG. 1D and FIG. 1E.

Figure 1B:
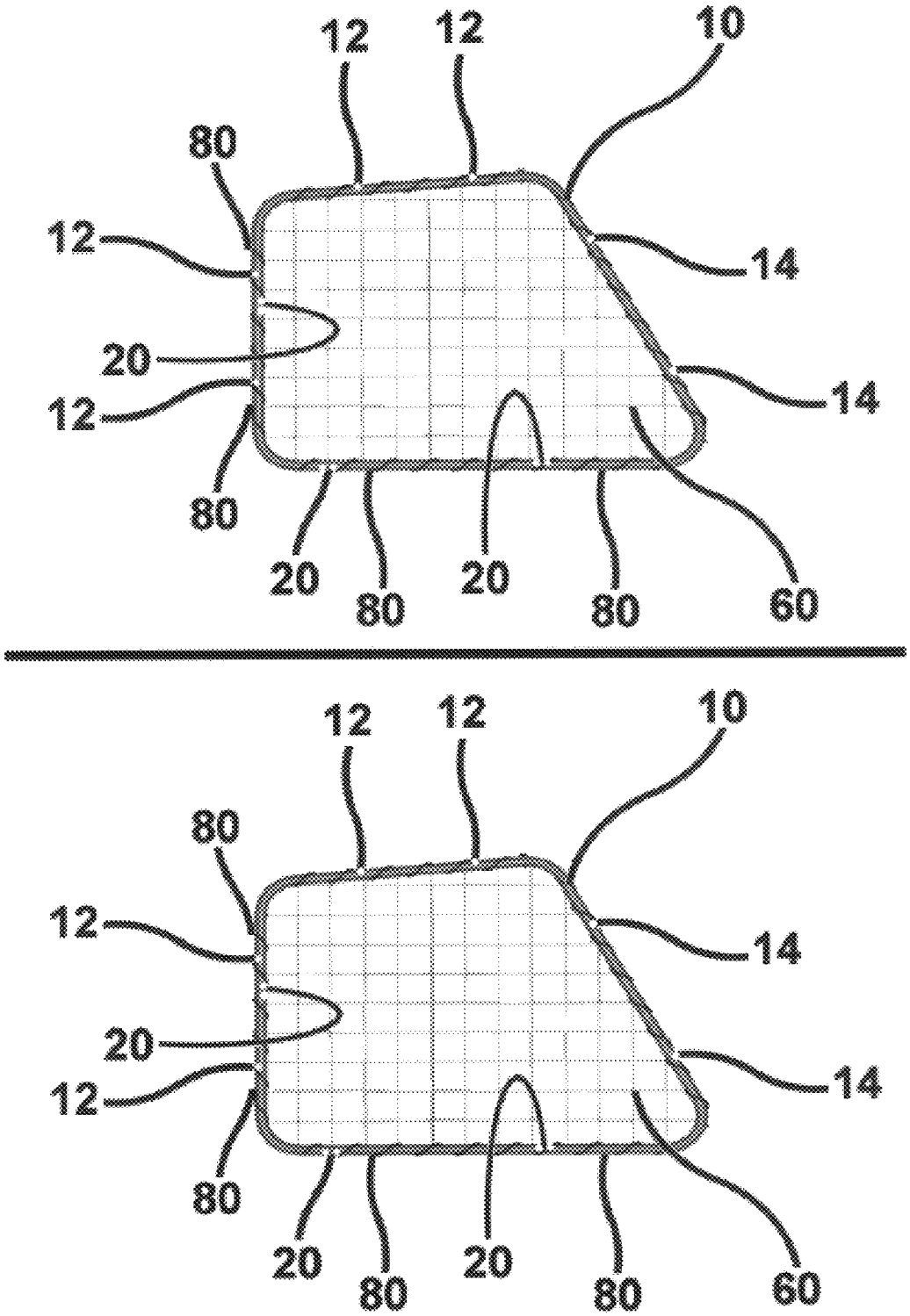

Beginning with FIG. 1B Side Frame 10 (side view), two of the Side Frame 10 make up the sides or are the base of ULTIMAGOAL. The Side Frame 10 has a precisely designed trapezoid shape, which is significant to the numerous training techniques of ULTIMAGOAL. Side Frame 10 includes a loose Wide-Hole (hole 2"×2") Side Frame Wide-hole Nylon Netting 60 (center) strung from cross member to cross member by a Nylon String, which is strung through the ends of the Side Frame Wide-hole Nylon Netting 60 and around the Side Frame 10 steel tube frame. Side Frame 10, also includes several Insert Holes, all Insert Holes being ⅜" in diameter. Small Frame Insert Holes 12 are single holes on the outer section (left & top) of the Side Frame 10. Also, Large Frame Insert Holes 14 are single holes on the outer section (right) of the Side Frame. Stabilizing Bar Insert Holes 20 are combined double Insert Holes, also each hole being ⅜" in diameter. There are three spots, which have Stabilizing Bar Insert Holes 20. The first Stabilizing Bar Insert Holes 20 being on the outer section (bottom-left) and the other two Stabilizing Bar Insert Holes 20 on the inner portion of Side Frame 10 (left-inner, bottom-inner).

Figure 1C:
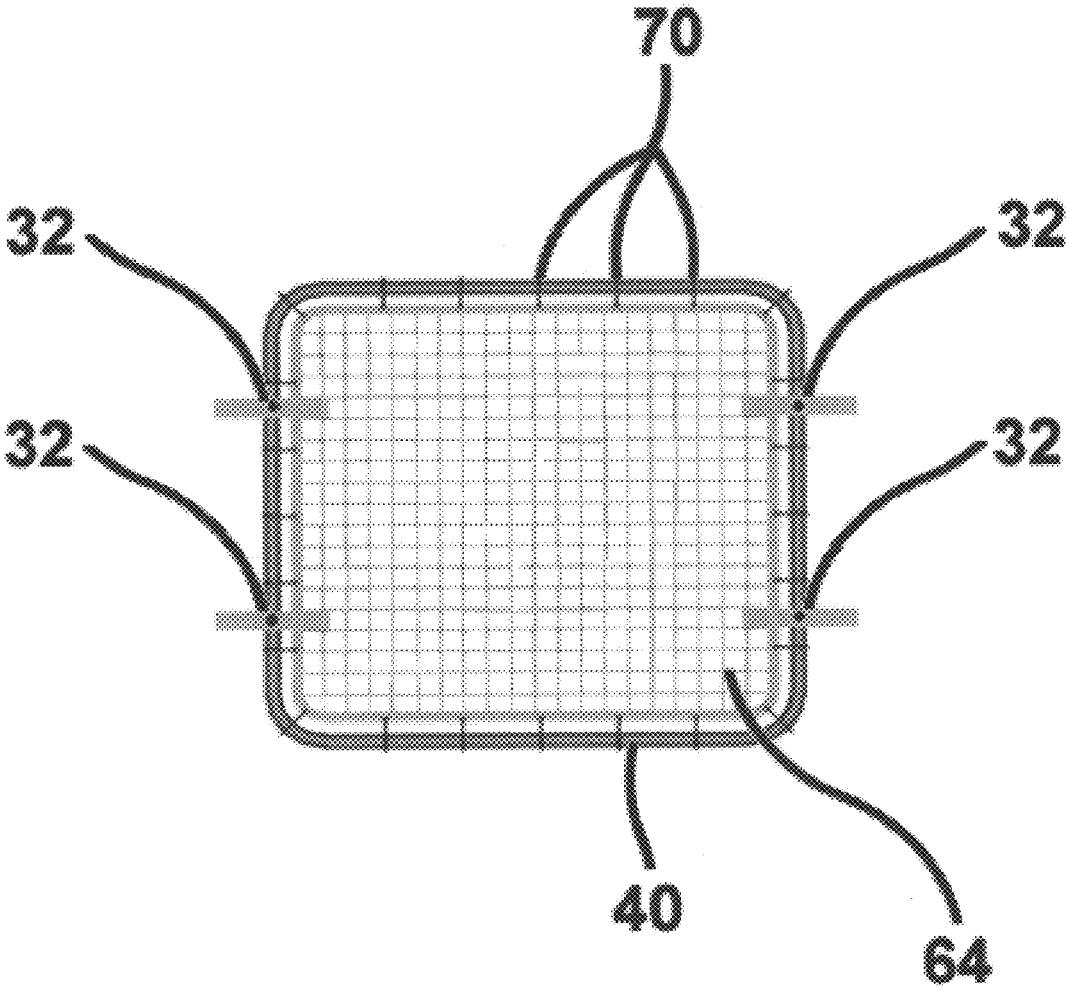

Onto FIG. 1C—illustrating the tubular rectangular shape—Large Frame 40 (side view). A rectangular shaped thin Large Frame Vinyl-coated Mesh 64 (center) is tightly strung from cross member to cross member by twenty-four small self-attaching Bungee Cords 70 (Bungee Ball with 4¾" cord length, 3/1641 cord thickness). The Bungee Cords 70 are spread around the Large Frame 40, with five Bungee Cords 70 around each straight tube section and one Bungee Cord 70 on each rounded corner. The Large Frame 40 has four steel Bolts (Carriage Bolt 2"-length, 5/16" thickness) inserted through the center of four Velcro Straps (2"×10" VELSTRAP—self adhering fabricated strap—by VELCRO), equally spaced (22") on two opposing sides (left, right) of Large Frame 40. The Bolt is inserted through the center of the Velcro Strap and continues perpendicular through the full diameter of the steel tube of Large Frame 40, becoming Bolt & Strap 32. The Bolt & Strap 32 pierces out ⅝" and has a 5/16" nut, which screw on the end of the piercing Bolt securing each of the four Bolt & Strap 32 onto Large Frame 40.

Figure 1D:
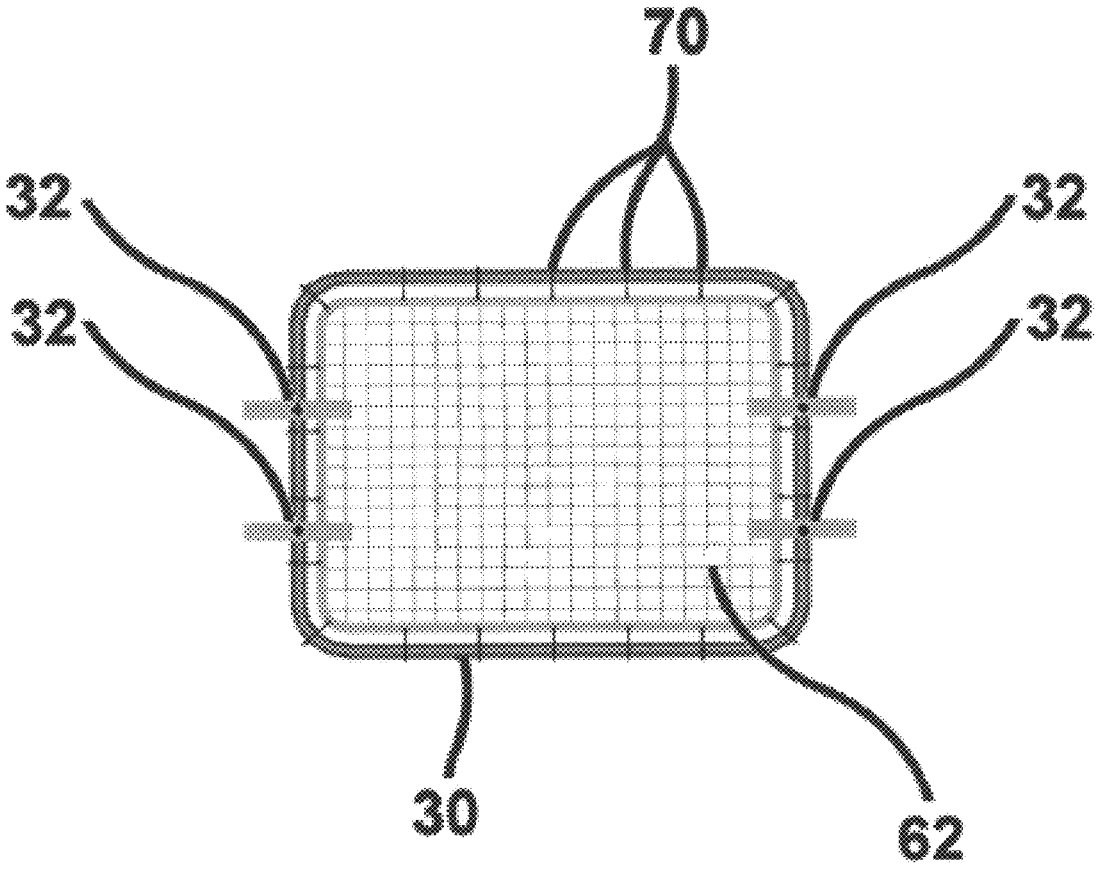

In FIG. 1D there is a similar tubular rectangular shaped smaller in size Frame—Small Frame 30. Small Frame 30 also, has a rectangular shaped thin Small Frame Vinyl-coated Mesh 62 (center), which is tightly strung from cross member to cross member, but it is smaller in size and has only twenty-two small self attaching Bungee Cords 70. Strapped on the top are five Bungee Cords 70 and five are on the bottom, while four are on each side (left, right) and one on each of the four curved corners. There are also, four Bolt & Strap 32 equally spaced (12") on two opposing sides (left, right) of Small Frame 30.

Figure 1E:
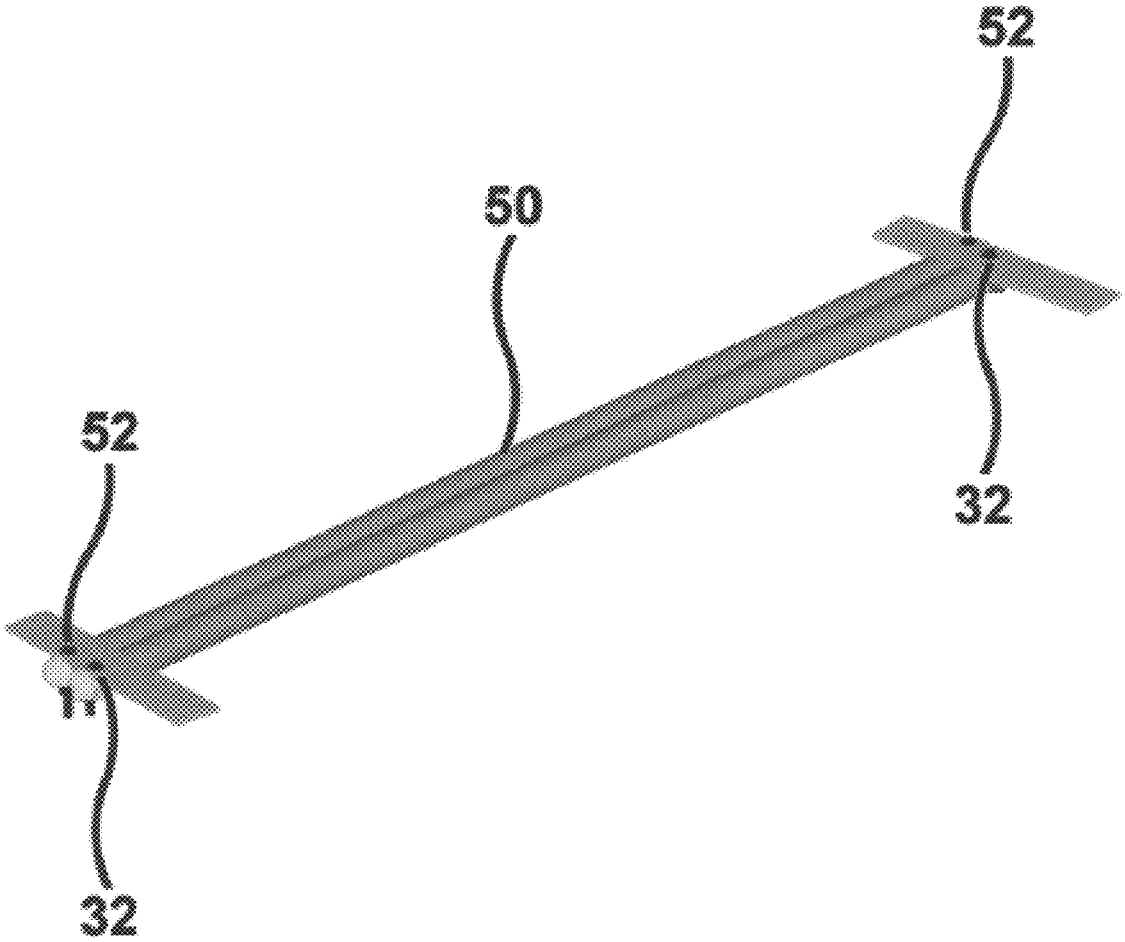

The last of the five main components of ULTIMAGOAL is the Stabilizing Bar 50, illustrated in FIG. 1E. The Stabilizing Bar 50 is made of two straight steel tubes (each 1⅜" in diameter, 0.035 gauge) the same length attached in a parallel connection. On each end of the bottom connected tube there is a Bolt & Strap 32 and on the end of each top connected tube there is a Long Bolt 52 (Carriage Bolt 2½"-length, 5/16" thickness). The two Long Bolt 52 are inserted through the full diameter of each end of the (top) steel tube of Stabilizing Bar 50. The Long Bolt 52 pierces out 1⅛" and each Long Bolt 52 have two 5/16" nuts, which screw on the end of each piercing Bolt securing each of the two Long Bolt 52 onto Stabilizing Bar 50.

There are four Ground Spikes used for mounting (optional) ULTIMAGOAL to the ground, preferably a soft ground surface (ex. Grass, Dirt, Sand, Gravel). The Ground Spikes are made of galvanized steel ten inches in length with a 5/16" diameter. The Ground Spikes are pounded through each of the Ground Spike Hole 80, which are on the lower crossbar of the two Side Frame 10 and into the ground surface, when ULTIMAGOAL is in one of its training modes.

FIG. 2A—ADDITIONAL EMBODIMENTS

Figure 2A:
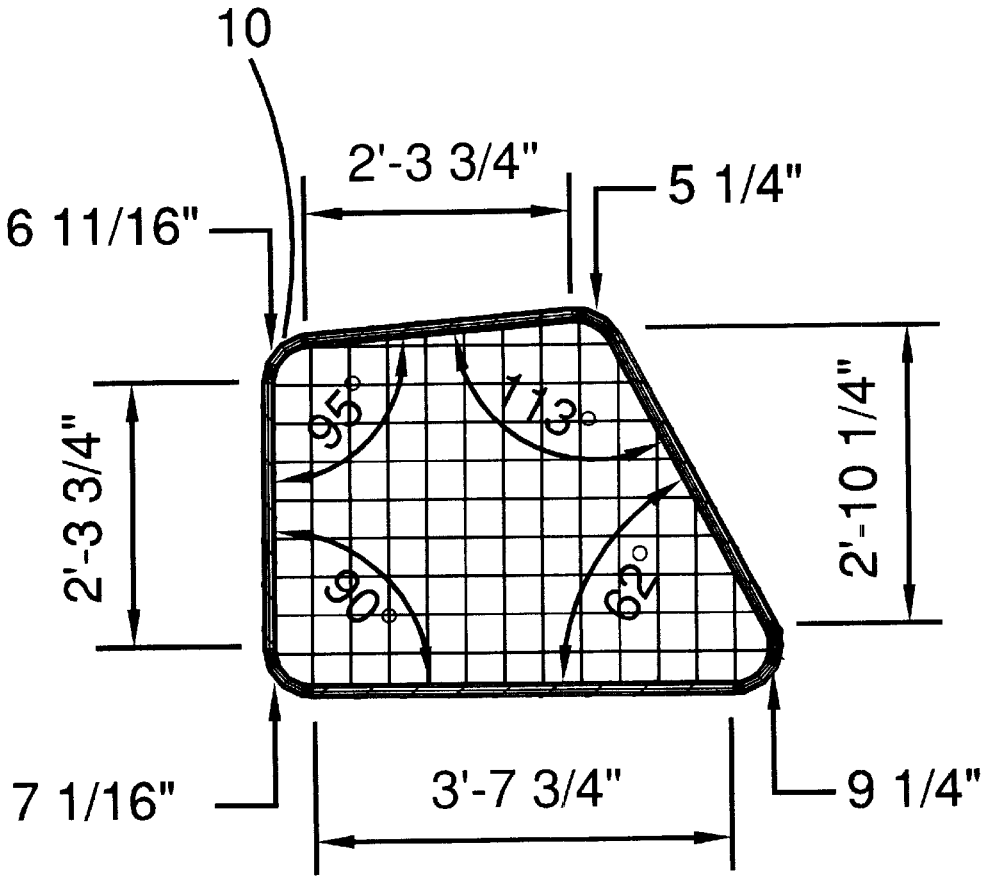
Figure 2B:
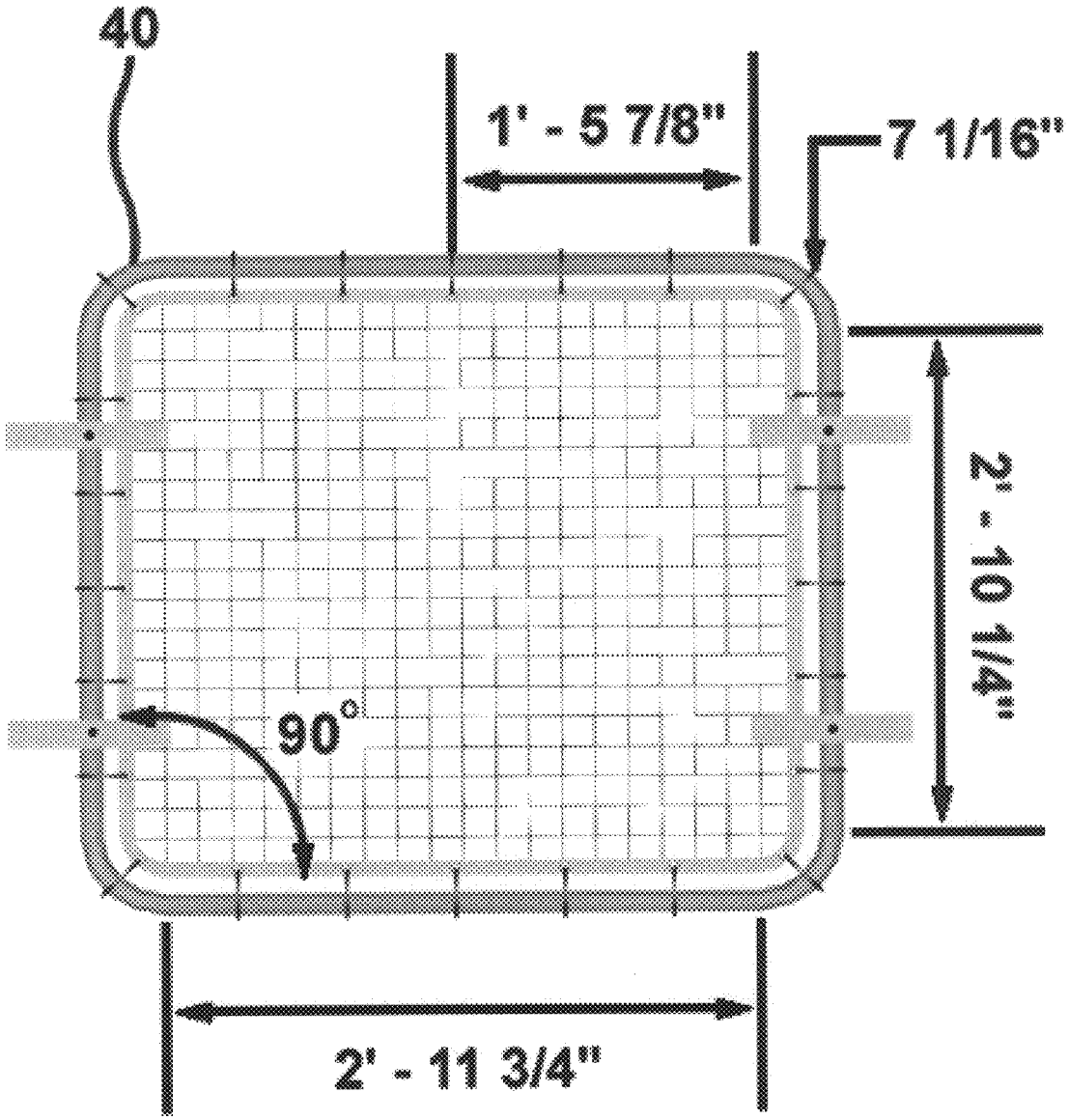
Figure 2C:
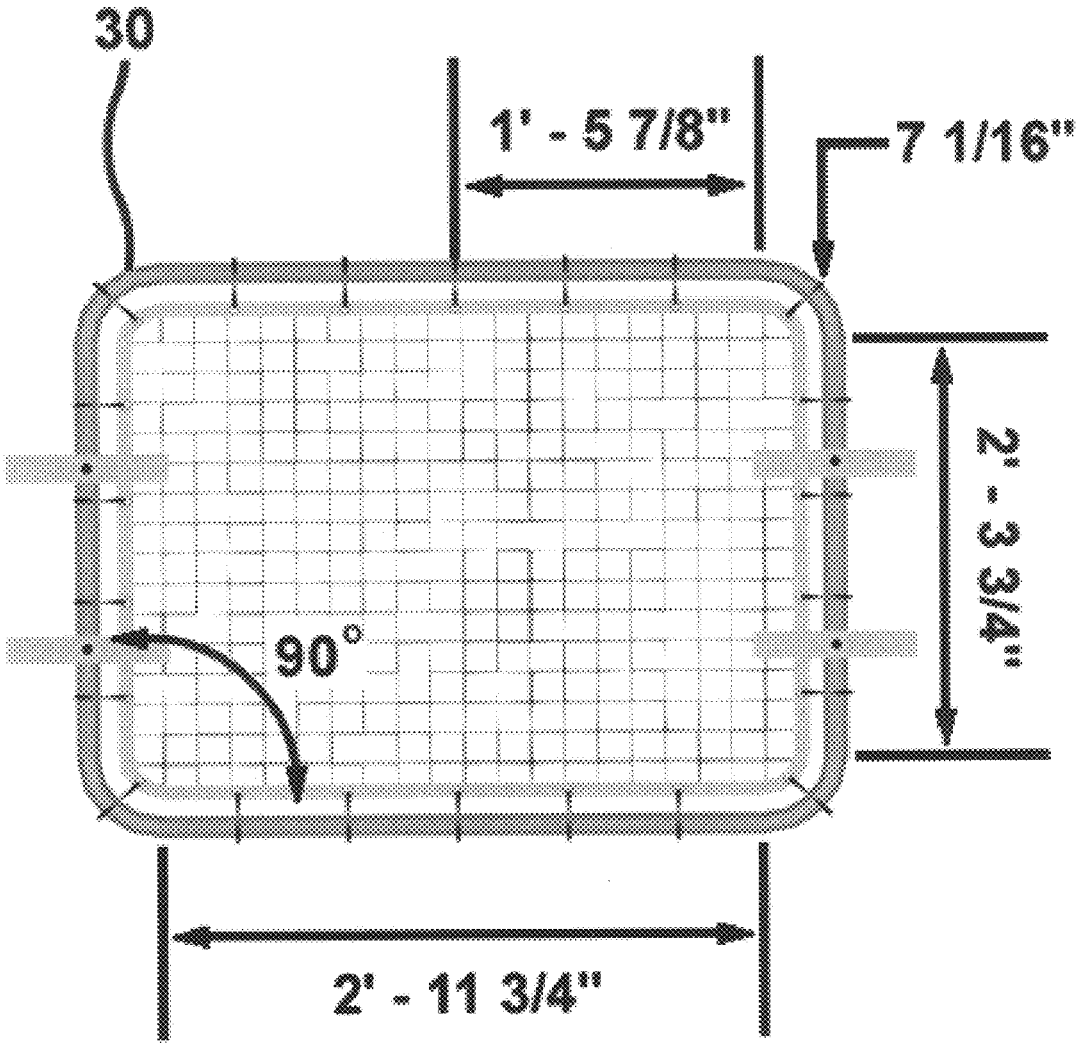
Figure 2D:
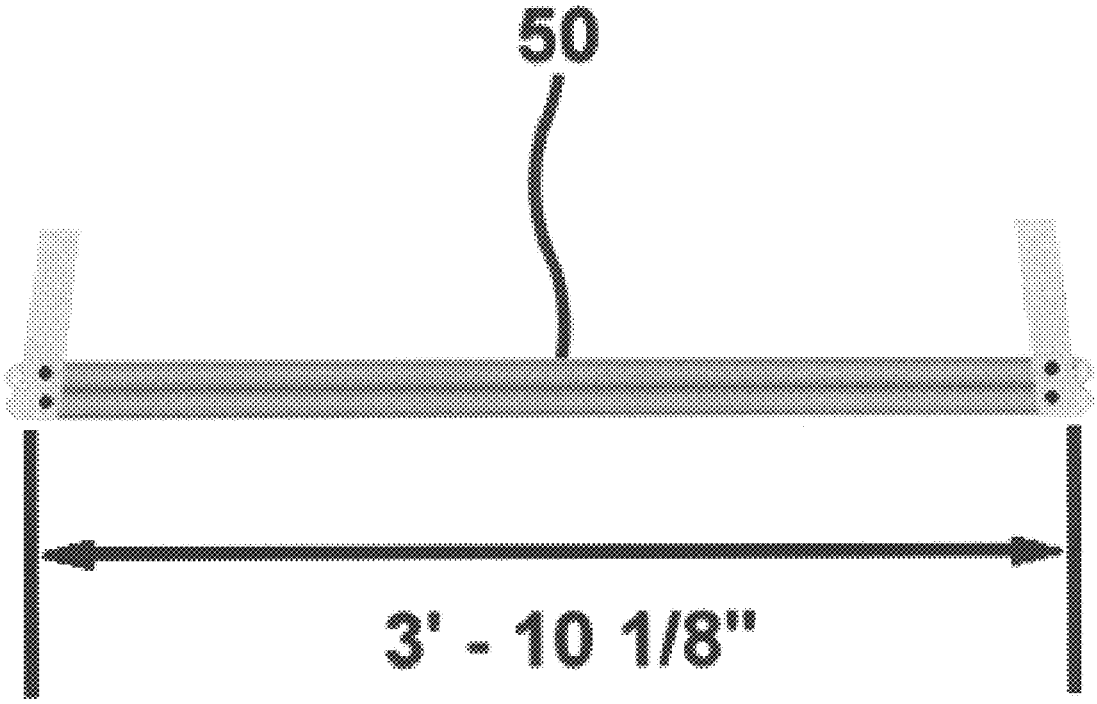

Additional embodiments are shown in FIG. 2A; This Figure shows the essential curved angles of the two Side Frame components of ULITIMAGOAL. FIG. 2A—show one of the two Side Frame 10, which are the sides and support of ULTIMAGOAL. The two Side Frame 10 are formed identical in a specific trapezoid shape, with six-inch radius curved angles, which is key to the overall structural transformations of ULTIMAGOAL. Beginning in the lower left corner of FIG. 2A shows the Side Frame Ninety Degree Inside Angle 1 connecting to a vertical straight portion (2'–3¾") of the tubular Side Frame 10 leading to the upper left corner angle Side Frame Ninety-Five Degree Inside Angle 2, which leads to an upward sloping straight crossbar (2'–3¾") and joins the peak angle Side Frame One Hundred Thirteen Degree Inside Angle 3. Continuing Side Frame 10 from the peak angle into a long straight downward sloping section (2'–10¼") joining Side Frame Sixty-Two Degree Inside Angle 4, where this lower right corner angle bends back to an even longer straight horizontal crossbar (3'–7¾") merging back to the Side Frame Ninety Degree Inside Angle 1 forming the unique trapezoid shape of ULTIMAGOAL.

OPERATION—FIGS. 3A, 3B, 3C, 4A, 4B, 4C, 4D, 5A, 5B, 5C, 5D, 6A, 6B, 6C, 7A

The manner of using this present invention has to do with its various structural transformations. The present invention, ULTIMAGOAL has five transformations called ULTIMAGOAL MODES, which are the appropriate methods of use. The five ULTIMAGOAL MODES all serve at least one function and create a system of training for a coach, team or individual player.

We begin with the first mode FIG. 3A (3D view), illustrating the direction of the five main components assembling ULTIMAGOAL MODE ONE. FIG. 3B (side view) is a more detailed observation of each connection and its attachment necessary to complete ULTIMAGOAL MODE ONE. FIG. 3C (3D view) exemplify ULTIMAGOAL MODE ONE in its entirety and ready for soccer training. In this mode (FIG. 3C), ULTIMAGOAL MODE ONE is a small soccer goal, with a low height, training soccer players to kick a soccer ball at a low height to score.

Figure 4A:
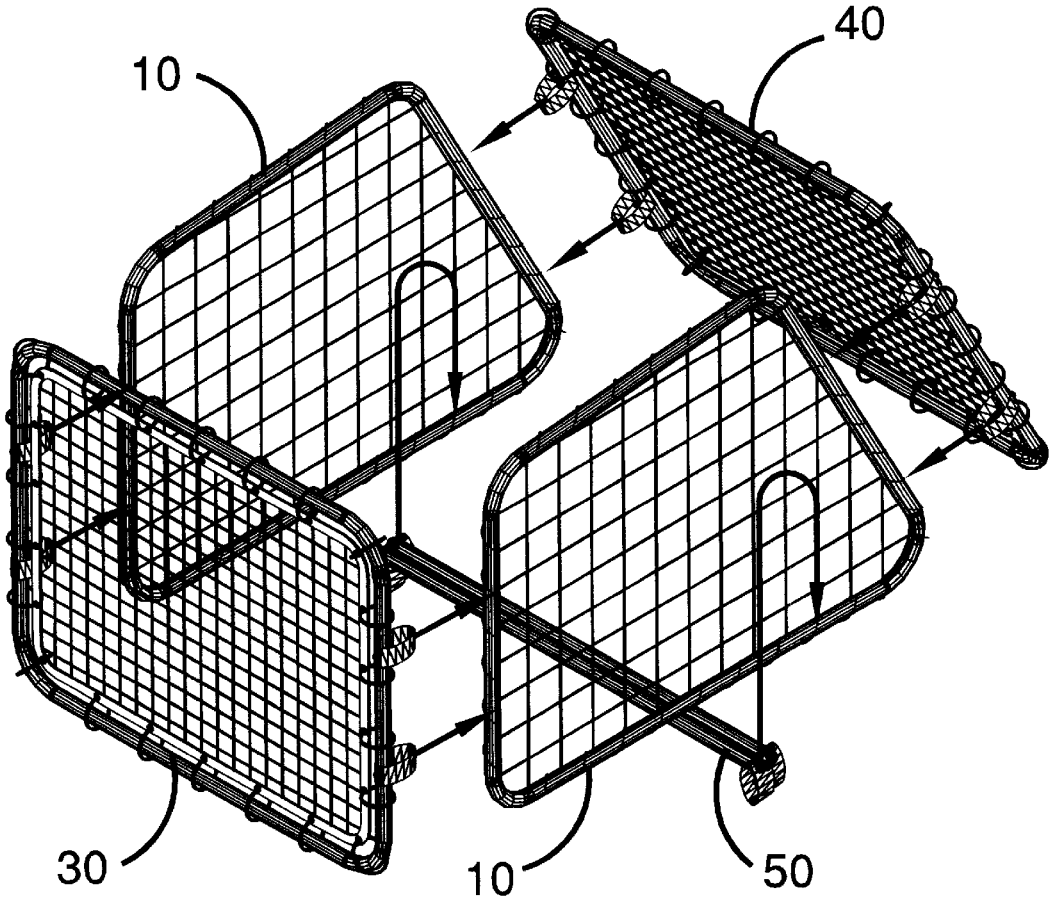
Figure 4B:
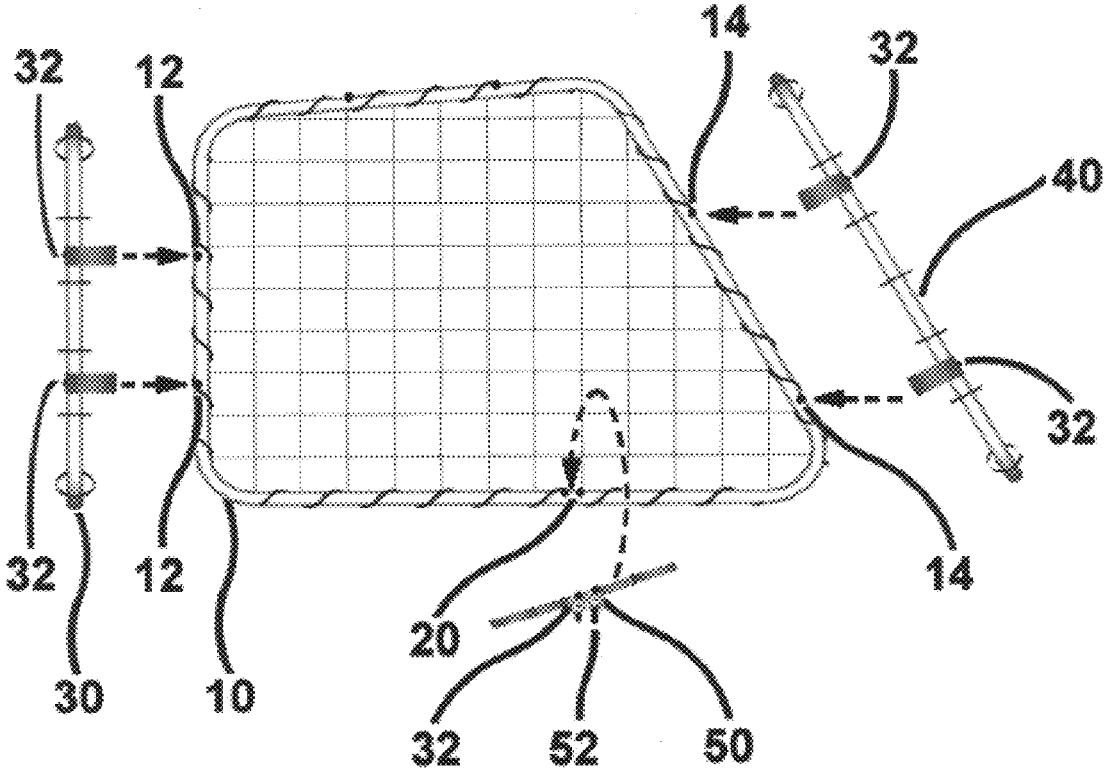
Figure 4C:
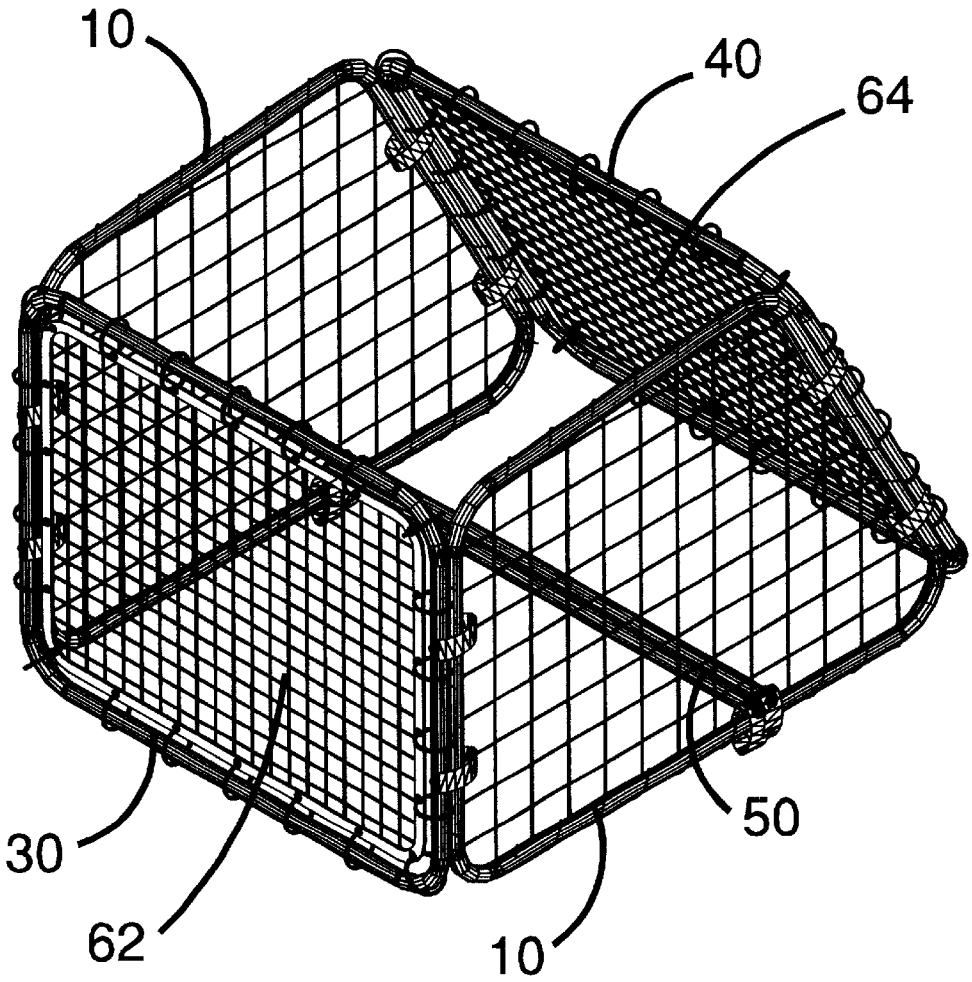
Figure 4D:
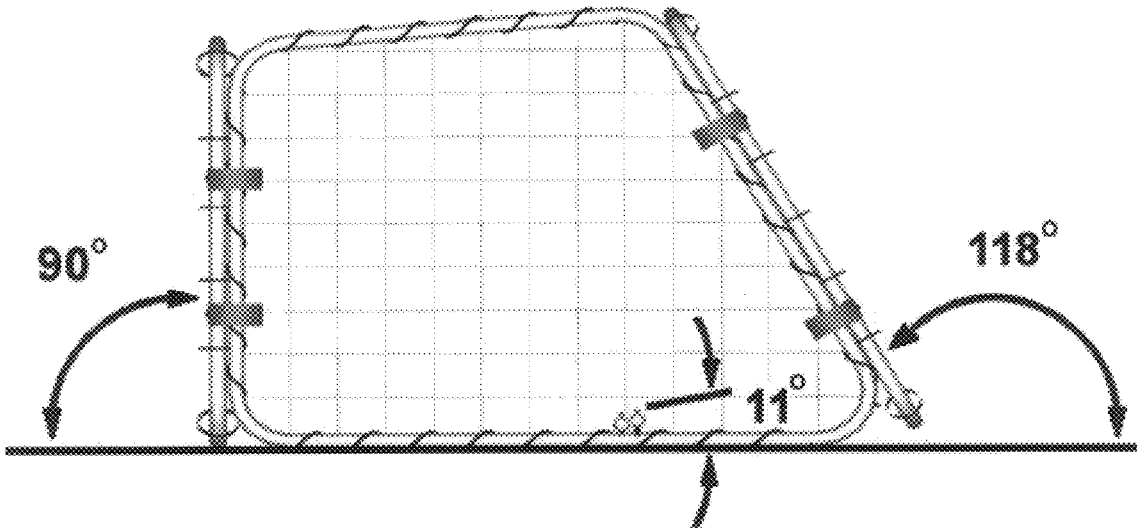

ULTIMAGOAL MODE TWO is the next transformation of ULTIMAGOAL. FIG. 4A show the direction of the five main components assembling ULTIMAGOAL MODE TWO. FIG. 4B (side view) is a more detailed observation of each connection and its attachment necessary to complete ULTIMAGOAL MODE TWO. FIG. 4C (3D view) exemplify ULTIMAGOAL MODE TWO in its entirety and ready for soccer training. In this mode (FIG. 4C), ULTIMAGOAL is a soccer ball rebounding trainer. The vertical Small Frame (30) rebounding plane is for training a soccer player's shooting technique in a rapid efficient manner. A soccer player practices shooting skills by striking a soccer ball into the Small Frame Vinyl Coated Mesh 62, whereby the soccer ball rebounds back to the soccer player for additional shot training. This mode is a method of use for training a soccer player's shooting skills to strike a soccer ball with the proper technique in the air (volley shot) or low on the ground surface with different parts of either the right or the left foot, such as striking the ball with the right side of either foot, the left side of either foot, the in step of either foot, the heal of either foot or the toes of either foot. FIG. 4D (side view) show a close-up of the bottom half of the ninety degree rebounding angle (left) Small Frame 30 and on the opposite side (right) Large Frame 40, which is at a one hundred eighteen degree rebounding angle. In FIG. 4C additional players face the Large Frame 40 and strike a soccer ball into the Large Frame Vinyl-coated Mesh 64, whereby the soccer ball rebounds back to the additional soccer player's at various high and low angles. Therefore, the Large Frame 40 rebounding plane is a method of use for training different parts of a soccer player's body for controlling the soccer ball through trapping techniques, including the foot, thigh, chest and head. The Large Frame 40 rebounding plane is a method of use for training a soccer player's soccer ball heading technique. Also, the Large Frame 40 is a method of use utilized by a soccer goalie to train a soccer goalies high soccer ball control, leaping ability and quickness skills. When shooting a soccer ball off the Large Frame 40 rebounding plane, the soccer ball rebounds back to the goalie high, creating difficult shots to control and through repetition builds a goalies leaping ability, quickness and soccer ball control skills.

Figure 5A:
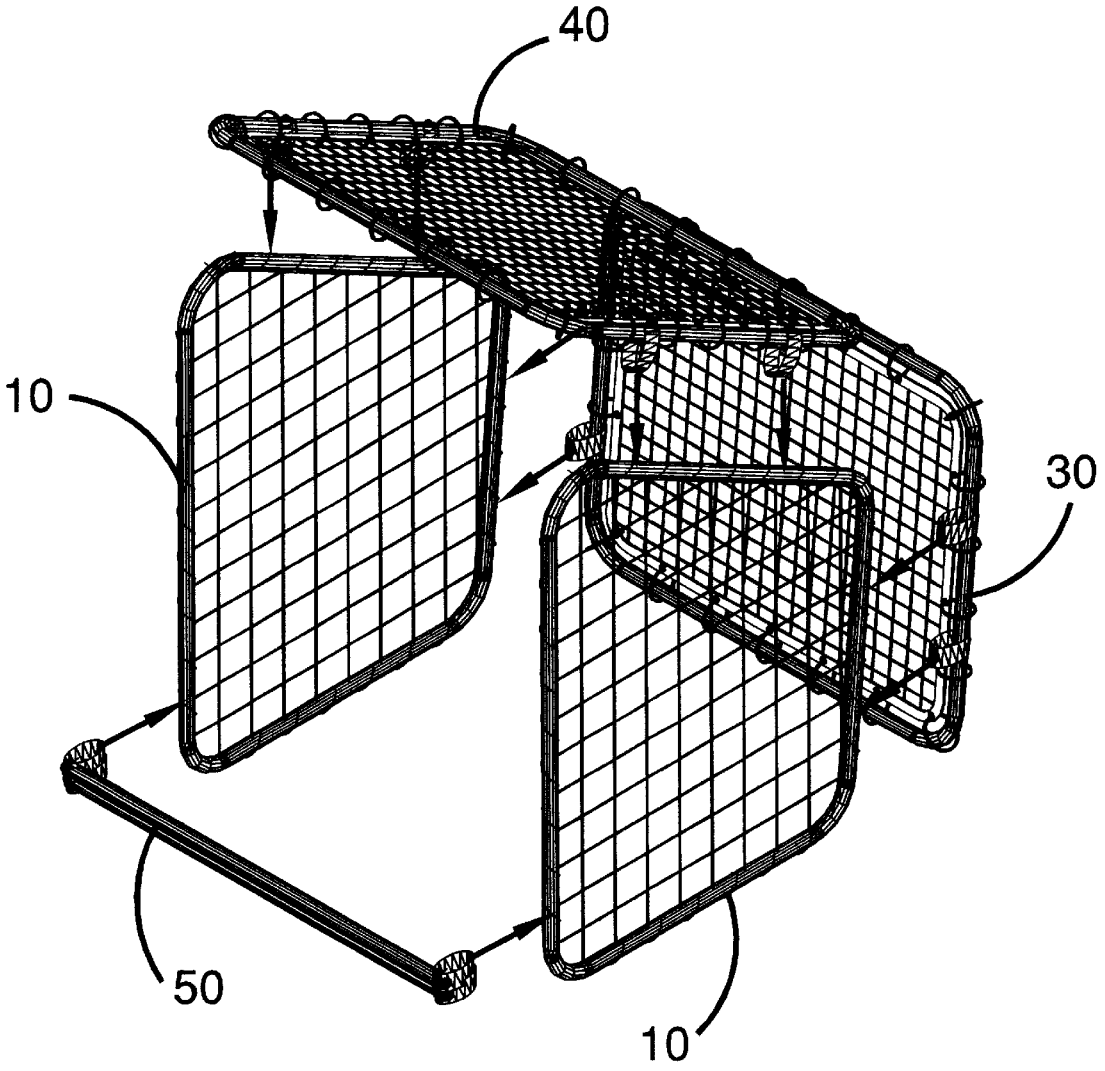
Figure 5B:
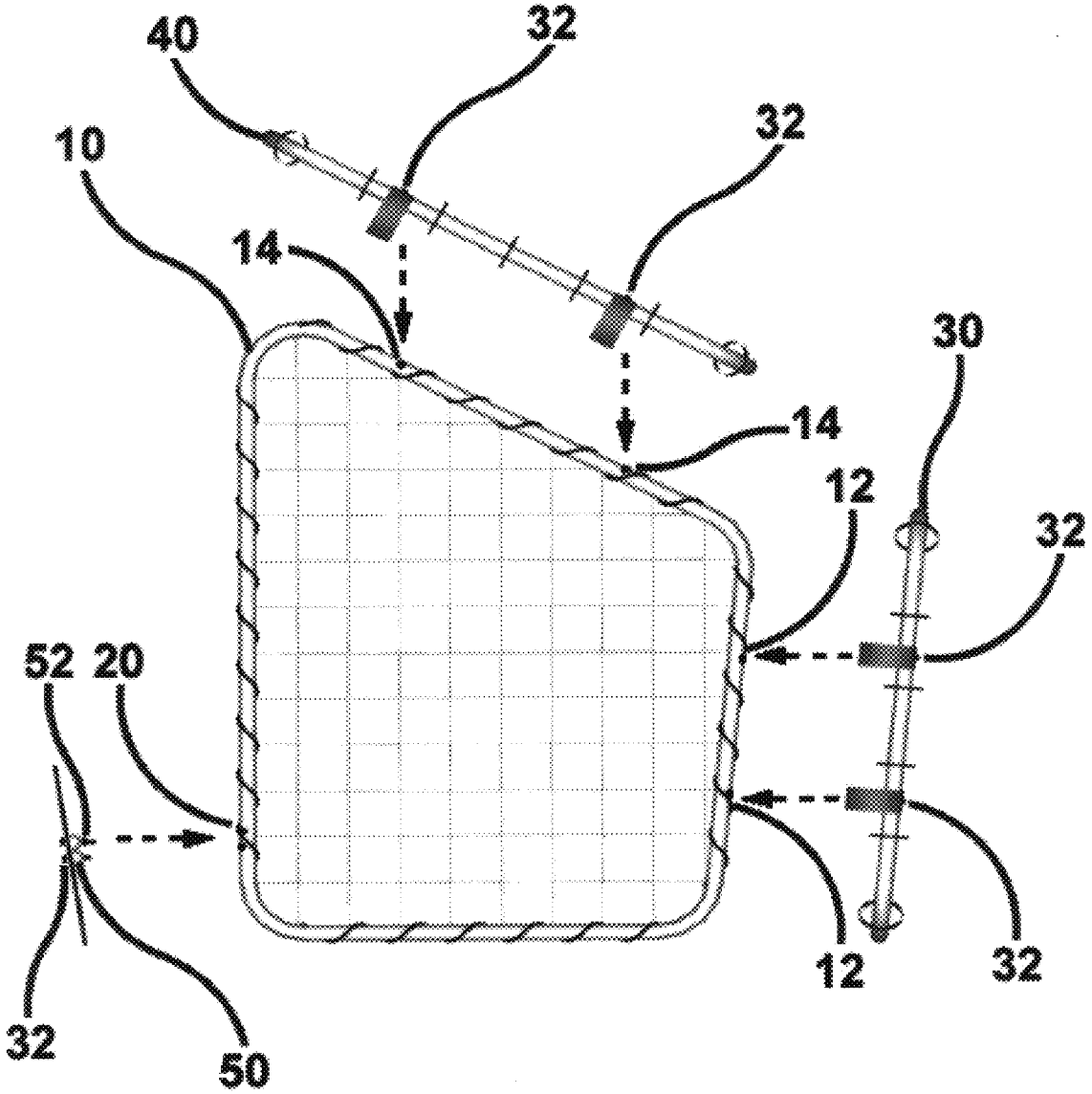
Figure 5C:
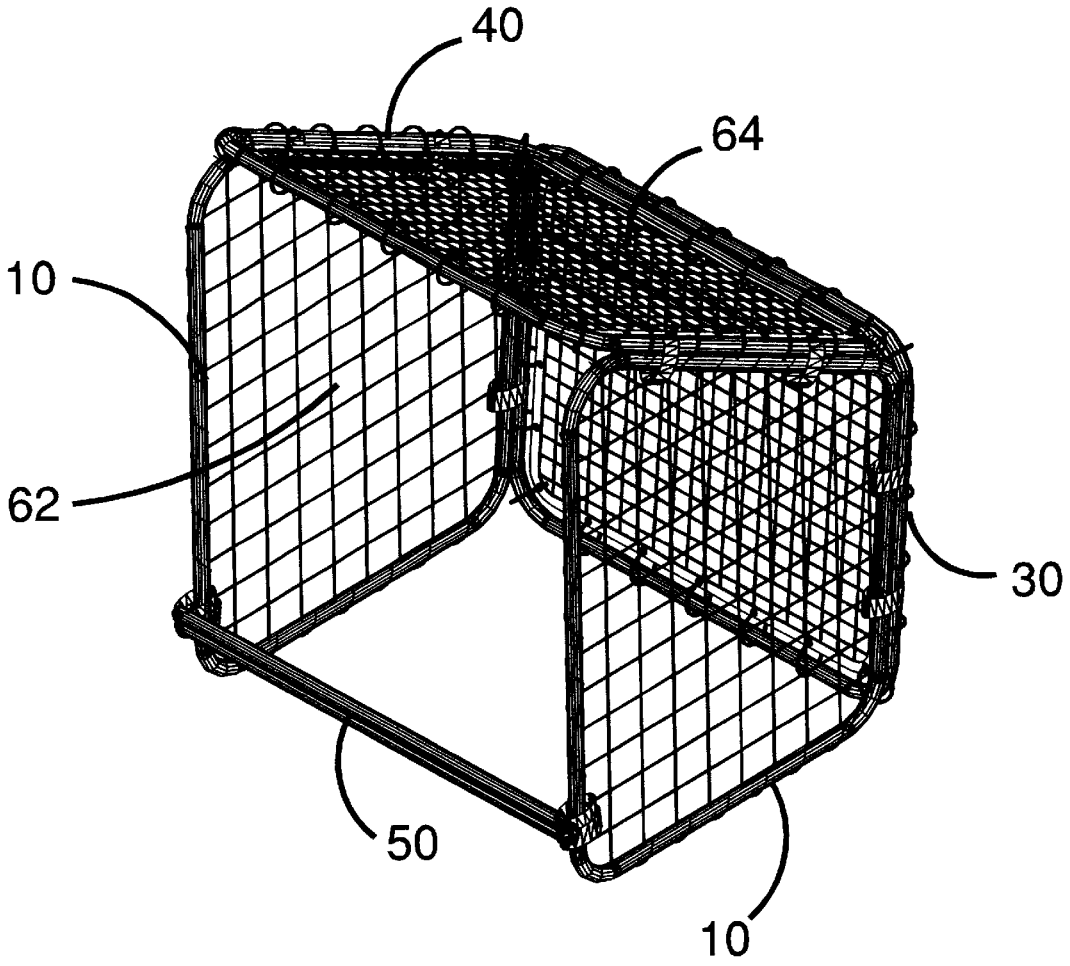
Figure 5D:
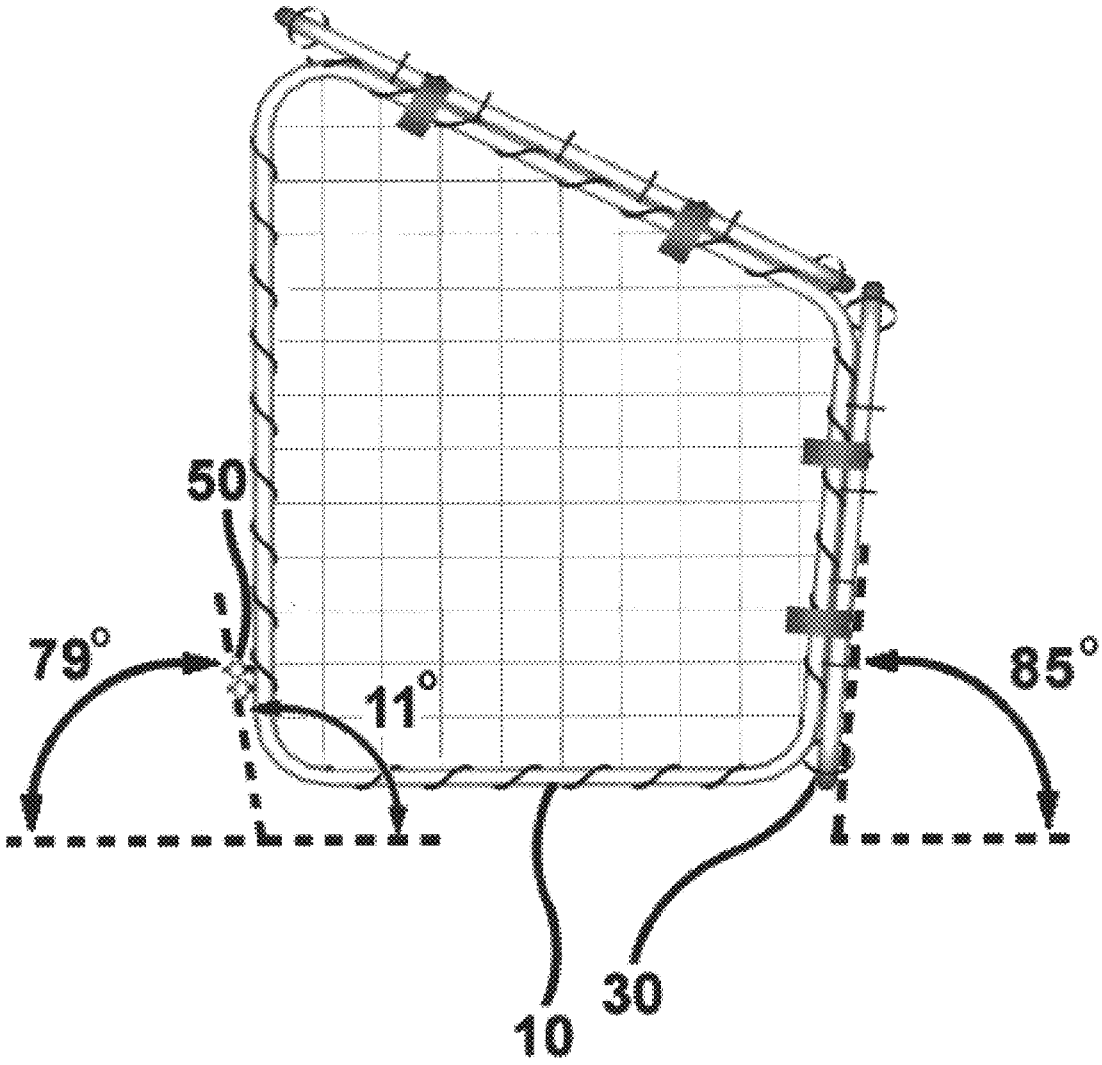

The third transformation of ULTIMAGOAL is ULTIMAGOAL MODE THREE. FIG. 5A show the direction of the five main components assembling ULTIMAGOAL MODE THREE. FIG. 5B (side view) is a more detailed observation of each connection and its attachment necessary to complete ULTIMAGOAL MODE THREE. FIG. 5C (3D view) exemplify ULTIMAGOAL MODE TWO in its entirety and ready for soccer training. ULTIMAGOAL MODE TWO has additional rebounding planes implemented for additional soccer player training techniques through rebounding a soccer ball. FIG. 5D (side view) is a blown up view of the bottom half of ULTIMAGOAL MODE TWO. Illustrated in FIG. 5D is the Stabilizing Bar 50 (left), which is a seventy-nine degree angled decline plane and opposite (right) Small Frame 30, being an eighty-five degree angled decline plane. The Stabilizing Bar 50 transforms into a Back-Passer and is an important component for developing a soccer player's ground ball passing. A soccer player faces the Stabilizing Bar 50 and kicks a soccer ball into a rolling ground pass into the Stabilizing Bar 50, whereby the soccer ball rebounds off the eleven degree angled decline plane (Stabilizing Bar 50) back to the soccer player as a rolling ground back pass. Therefore, the Stabilizing Bar 50 has a method of use for training a soccer player's skills to accurately pass a soccer ball with the proper technique in the air or low and smooth on the ground surface with different parts of either the right or the left foot, such as striking the ball with the right side of either foot, the left side of either foot, the in step of either foot, the heal of either foot or the toes of either foot. Opposite is the Small Frame 30, with an eighty-five degree angled decline rebounding plane facing downward towards the soccer player. A soccer player faces the Small Frame 30 and strikes a soccer ball into its declined angled (FIG. 5D) tightly wound Small Frame Vinyl Coated Mesh 62 plane, whereby the soccer ball rebounds back to the soccer player for low level foot and thigh trapping and bouncing soccer ball control. Therefore, the Small Frame 30 is a method of use for training a soccer player's low level foot and thigh soccer ball trapping. The Small Frame 30 can also be utilized by a soccer goalie to train a soccer goalies low soccer ball control and quickness skills. When shooting a soccer ball off the declined Small Frame 30 rebounding plane, the soccer ball rebounds back to the goalie low and bouncing, creating difficult shots to control and through repetition builds a goalies quickness and soccer ball control skills.

The fourth transformation is ULTIMAGOAL MODE FOUR. FIG. 6A illustrates the direction of the five main components assembling ULTIMAGOAL MODE FOUR. FIG. 6B (side view) is a more detailed observation of each connection and its attachment necessary to complete ULTIMAGOAL MODE FOUR. FIG. 6C (3D view) exemplifies ULTIMAGOAL MODE FOUR in its entirety and ready for soccer training. ULTIMAGOAL MODE FOUR (FIG. 6C) is a large soccer goal, with an elevated height, training soccer players to kick a soccer ball into a larger soccer goal.

The fifth and last transformation of ULTIMAGOAL is the ULTIMAGOAL PORTABLE MODE. FIG. 7A (3D view) is a detailed observation of each attachment necessary to complete ULTIMAGOAL PORTABLE MODE. All five components are sandwiched flat into a compact mode with the Stabilizing Bar 50 down the center. The two—Side Frame 10 placed in between Large Frame 40 and Small Frame 30. The Large Frame 40 is placed on one flat side with the four—Bolt & Strap 32 pointing inward. The Small Frame 30 is placed on the other flat side with its four—Bolt & Strap 32 pointing inward. All Bolt & Strap 32 are strapped, transforming ULTIMAGOAL into a contiguous lightweight structure and portable apparatus. When in the ULTIMAGOAL PORTABLE MODE, multiple soccer balls may be placed in between the tubular frames netting holding the soccer balls and acting as a soccer ball carrier. Also, attachable wheels may be used in the ULTIMAGOAL PORTABLE MODE for ease of portability.

CONCLUSION, RAMIFICATIONS, AND SCOPE

Accordingly, the reader will see that ULTIMAGOAL is multifunctional and portable. Therefore, you have the ability to detach ULTIMAGOAL into a flat portable mode and place it in the trunk of a car, in the back of a truck/van or on the top storage rack of a vehicle and transport ULTIMAGOAL where ever you play soccer. Also, ULTIMAGOAL can be hung on a school storage room wall or garage wall for convenience of space. In addition, ULTIMAGOAL is versatile because of its lightweight materials, unique shape and detachability. Creating the opportunity for additional rebounding soccer ball training techniques, not stated in this patent application.

Furthermore, ULTIMAGOAL has the additional advantages in that

- it permits the production of ULTIMAGOAL into different strong, lightweight materials; such as an extremely hard plastic or strong pipe material for the frame. But, never losing its unique shape and tubular trapezoid design.
- it permits the production of ULTIMAGOAL into a variety of colors.
- it allows ULTIMAGOAL to have different logos, crests, words, names or flags to be placed over the mesh netting, for artistic reasons, marketing means or each soccer teams name or logo.
- it permits ULTIMAGOAL to have different rebounding materials, such as the full rebound netting to be made of bungee cord netting, instead of the mesh nylon netting with bungee cord straps on the outside for spring tension. Also, it allows the rebounding material to be made of burlap or cloth material held by bungee cords.
- it allows ULTIMAGOAL to have different connectors, such as a tongue and groove connection or a snap on connection, instead of the Bolt & Strap.
- it permits ULTIMAGOAL to have weights for extra stability, such as sand bags.
- It allows ULTIMAGOAL to have strategically placed targets over each different rebounding plane for accuracy training.
- it permits ULTIMAGOAL to act as a ball carrier, when in ULTIMAGOAL PORTABLE MODE.
- it allows ULTIMAGOAL to have attachable wheels or a carrier with rollers for ease of portability.

Although, the description above contains many specifics, these should not be construed as limiting the scope of the invention, but as merely providing illustrations of some of the presently preferred embodiments of this invention. For example ULTIMAGOAL can have additional rebounding angles, by the use of extensions strategically positioned. Placing extensions over the existing attachments (Bolt & Strap) and in between the tubular frames, giving you the ability to make the rebounding angles more severe or acute. Thus the scope of the invention should be determined by the append claims and their legal equivalents, rather than by the examples given.

What is claimed is:

1. A soccer skill training device and goal comprising:

(a.) a structure made of four individual tubular frames and one tubular straight stabilizing bar all being contiguous, made of lightweight (galvanized steel) thin tubing with a 1⅜" inch diameter, with all bends or curved angles being a six-inch radius and each component having a unique shape and dimension creating a means for different training modes, whereby transforming from two different size soccer goals to a soccer training multi-planed rebounding device;

(b.) two of the said four individual tubular frames are identically shaped tubular side frames with trapezoid shape. Both said tubular side frames have four different inner curved angles, beginning said trapezoid shape with a ninety-degree angle, then straightens (2'–3¾") and flows up vertically (front) into a ninety-five degree angle, continuing straight (2'–3¾") sloping up (top) to a peak angle of one hundred thirteen degrees, where tube again straightens (2'–10¼") downward (back) sloping into a final sixty-two degree angle, merging with a horizontal base cross member (3'–7¾") running along the playing surface (bottom) and adjoining back to first ninety degree angle. Both said tubular side frames have a plurality of insert holes in identical locations for various positioning of contiguous rebounding planes;

(c.) a third individual tubular frame (large tubular frame) having all ninety degree angles being rectangular in shape (top, bottom straight cross members—2'–11¾" length, side straight cross members—2'–10¼" length) and positioned contiguous at a one hundred eighteen degree rebounding angle, attached on said two tubular side frame downward sloping angles (back);

(d.) a fourth individual tubular frame (small tubular frame) being rectangular in shape(top, bottom straight cross members—2'–11¾" length, side straight cross members—2'–3¾" length) having all ninety degree angles and having versatile means, connects on top of said two tubular side frames slanting top members or disconnects and reconnects to said vertical cross members (front) of said two tubular side frames;

(e.) four separate netting spanning across each individual said four tubular frames, stretching from side to side and cross member to cross member, with said two side frames each having a wide hole nylon netting loosely fit each said tubular side frame, further including and attached to said small tubular frame (back) and said large tubular frame (versatile—top/front) is a tightly wound vinyl-coated mesh rebound netting strapped from cross member to cross member;

(f.) a said tubular straight stabilizing bar having versatile means is attached to two said tubular side frames at different positions, depending on mode of training;

(g.)a set of short bungee cord straps (bungee cord with 4¾" cord length, 3⁄16" cord thickness) are attached to said small tubular frame and said large tubular frame adjoining the sides of said vinyl-coated mesh rebound netting, adding tension and securing a rebounding plane on each said small tubular frame and said large tubular frame;

(h.) a nylon string secures the adjoining said loose wide hole nylon netting on said two side tubular frames;

(i.) a set of four bolts attached (2" bolt length, 5⁄16" bolt diameter) to each said small tubular frame and said large tubular frame;

(j.) two bolts (2" bolt length, 5⁄16" bolt diameter) identical to the bolts on said small tubular frame and large tubular frame are attached to said tubular straight stabilizing bar, with two additional longer bolts (2½"—bolt length, 5⁄16" bolt diameter) attached to said straight tubular stabilizing bar;

(k.) a set of four hook and loop fasteners straps (2" width×10" length—self adhering hook and loop fabricated strap) are connected to each said small tubular frame and said large tubular frame by each bolt and two Velcro straps are connected to said tubular straight stabilizing bar by each said bolt, a means for attaching each individual frame to said structure creating said device as contiguous.

* * * * *